US011745049B2

(12) United States Patent
Stone et al.

(10) Patent No.: US 11,745,049 B2
(45) Date of Patent: Sep. 5, 2023

(54) EXERCISE DEVICES FOR MUSCLE ISOLATION

(71) Applicant: COREFIRSTX, LLC, Aurora, CO (US)

(72) Inventors: Doniphan T. Stone, Aurora, CO (US); Jeffrey D. Huling, Denver, CO (US)

(73) Assignee: CoreFirstX, LLC, Aurora, CO (US)

( * ) Notice: Subject to any disclaimer, the term of this patent is extended or adjusted under 35 U.S.C. 154(b) by 0 days.

(21) Appl. No.: 17/125,944

(22) Filed: Dec. 17, 2020

(65) Prior Publication Data

US 2021/0101045 A1 Apr. 8, 2021

Related U.S. Application Data

(63) Continuation-in-part of application No. 16/543,771, filed on Aug. 19, 2019.

(60) Provisional application No. 62/720,291, filed on Aug. 21, 2018.

(51) Int. Cl.
*A63B 21/00* (2006.01)
*A63B 71/00* (2006.01)

(52) U.S. Cl.
CPC ..... *A63B 21/4017* (2015.10); *A63B 71/0054* (2013.01); *A63B 2071/0072* (2013.01); *A63B 2209/00* (2013.01)

(58) Field of Classification Search
CPC ..... A63B 21/00043; A63B 21/00185; A63B 21/0023; A63B 21/04; A63B 21/068; A63B 21/08; A63B 21/4001; A63B 21/4013; A63B 21/4021; A63B 21/4025; A63B 2225/09; A63B 69/0057
See application file for complete search history.

(56) References Cited

U.S. PATENT DOCUMENTS

| | | | |
|---|---|---|---|
| 4,478,414 | A | 10/1984 | Molloy |
| 4,809,974 | A | 3/1989 | Buhr |
| 5,372,557 | A | 12/1994 | Ostigny |
| 5,873,805 | A | 2/1999 | Ayres et al. |

(Continued)

OTHER PUBLICATIONS

Webpage: "www.alibaba.com/product-detail/BT-WD09-Professional-Manufacture-Rotating-Carabiner_60732668392.html?spm=a2700.galleryofferlist.normal_offer.d_title.2cd11d398JRe1x", Wenzhou Baite Rigging Co, Professional manufacture zinc alloy swivel screw gate locking carabiner, Zhejiang, China, retrieved Jan. 7, 2021.

(Continued)

*Primary Examiner* — Jennifer Robertson
(74) *Attorney, Agent, or Firm* — Kolisch Hartwell, P.C.

(57) ABSTRACT

An exercise device is provided to couple a user's limb to a resistance mechanism and to tighten on the user's limb by a force applied in opposition to the resistance mechanism. The device may include a strap including a first portion, a second portion, and a third portion. The strap may define an adjustable opening configured to receive the user's limb. The first portion and the third portion of the strap may be attached to a closed loop shape configured for coupling to the resistance mechanism. A fixed opening may be coupled to the strap, and the adjustable opening of the strap may be formed by passing the second portion of the strap through the fixed opening. The device may also include a flexible material coupled to the strap and defining a tube providing the fixed opening.

20 Claims, 13 Drawing Sheets

(56) References Cited

U.S. PATENT DOCUMENTS

| | | | | |
|---|---|---|---|---|
| 5,967,947 | A | 10/1999 | Glover | |
| 6,168,556 | B1 | 1/2001 | Saavedra | |
| 7,044,896 | B2 | 5/2006 | Hetrick | |
| 7,090,622 | B2 | 8/2006 | Hetrick | |
| 7,651,448 | B2 | 1/2010 | Hetrick | |
| 7,662,073 | B1 * | 2/2010 | Baldwin | A63B 21/4001 482/92 |
| 7,722,508 | B2 | 5/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 8,043,197 | B2 | 10/2011 | Hetrick | |
| 8,083,653 | B2 | 12/2011 | Hetrick | |
| 8,469,864 | B2 | 6/2013 | Hetrick | |
| 8,840,532 | B2 | 9/2014 | Hetrick et al. | |
| 8,858,408 | B2 | 10/2014 | DeMeo | |
| 9,155,931 | B2 | 10/2015 | Hetrick | |
| 9,433,258 | B2 | 9/2016 | Hetrick et al. | |
| 9,895,566 | B2 | 2/2018 | Zbinden | |
| 10,105,275 | B2 | 10/2018 | Zbinden | |
| 10,245,460 | B2 | 4/2019 | Hetrick et al. | |
| 2013/0143724 | A1 | 6/2013 | DeMeo | |
| 2014/0213420 | A1 | 7/2014 | Harris | |
| 2016/0361582 | A1 * | 12/2016 | Zbinden | A63B 23/1218 |
| 2017/0368406 | A1 | 12/2017 | Parent, Jr. | |
| 2018/0055710 | A1 * | 3/2018 | Zbinden | A63B 21/068 |
| 2018/0140884 | A1 | 5/2018 | Johnson | |
| 2018/0290007 | A1 * | 10/2018 | Vorozilchak | A63B 21/1681 |
| 2019/0091507 | A1 | 3/2019 | Hetrick et al. | |

OTHER PUBLICATIONS

Webpage: "www.ironmind-store.com/Strong-Enough-Lifting-Straps153/productinfo/1239/", IronMind, Strong-Enough Lifting Straps for Strongman, WSM, Nevada City, CA, retrieved Jan. 7, 2021.

U.S. Patent and Trademark Office, Non-Final Office Action regarding U.S. Appl. No. 16/543,771, dated Jul. 5, 2022, 14 pages.

U.S. Patent and Trademark Office, Non-Final Office Action regarding U.S. Appl. No. 16/543,771, dated May 28, 2021, 11 pages.

U.S. Patent and Trademark Office, Final Office Action regarding U.S. Appl. No. 16/543,771, dated Jan. 28, 2022, 17 pages.

U.S. Patent and Trademark Office, Advisory Action regarding U.S. Appl. No. 16/543,771, dated Apr. 8, 2022 9 pages.

* cited by examiner

EXERCISE DEVICES FOR MUSCLE ISOLATION

CROSS-REFERENCE TO RELATED APPLICATION

This application is a continuation-in-part of U.S. patent application Ser. No. 16/543,771, filed Aug. 19, 2019, which claims priority under 35 U.S.C. § 119 to U.S. Provisional Patent Application No. 62/720,291, filed on Aug. 21, 2018, the contents of which are hereby incorporated by reference in their entirety for all purposes.

BACKGROUND

This disclosure relates in general to exercise devices. More specifically, this disclosure relates to devices and methods that isolate muscle groups during exercise.

For example, in exercises where the user must use forearm strength, tendons, and joints to stabilize and perform the exercise movement, there is much stress on all joints and ligaments. In addition, the stress load on the forearm muscles may be too great to complete a set of the exercise in which the intended muscle group is stressed to satisfaction.

Some related art exercise devices require the user to grip a weight in order to perform an exercise. Other related art exercise devices do not allow the wrist to have free range of motion, and/or require the user to tightly secure a strap to the wrist. Typical wrist straps were designed for only dead lifts or where grip strength hinders workload. Other wrist straps focus on stabilizing the wrist to prevent injury. Existing devices either have a bar or handle that the user has to grip or an opening that is fixed onto the user's limb by a separately secured mechanism such as a buckle or a Velcro connection. For the separately secured mechanism, the fixation of the device onto the user's limbs depends on the operation of coupling the buckle or the Velcro separately after inserting the limb into the opening.

SUMMARY

Exemplary embodiments of the invention provide devices and methods for isolating muscle groups during exercise. According to an aspect of the invention, a device includes a first strap that has a first loop shape, a second strap that has a second closed loop shape defining a fixed opening, and a third strap that has a third closed loop shape. A first portion of the first strap is affixed to or integral with the second strap, a second portion of the first strap is arranged to be movable within the fixed opening defined by the second closed loop shape, the second portion of the first strap is affixed to or integral with the third strap, and a first adjustable opening within the first loop shape is configured to be adjusted by changing a relative position of the second portion of the first strap and the fixed opening defined by the second closed loop shape.

A size of the first adjustable opening within the first loop shape may be configured to be increased by moving the second portion of the first strap through the fixed opening defined by the second closed loop shape in a first direction, and the size of the first adjustable opening within the first loop shape may be configured to be decreased by moving the second portion of the first strap through the fixed opening defined by the second closed loop shape in a second direction that is different from the first direction. A size of a second adjustable opening within the first loop shape may be configured to be decreased by moving the second portion of the first strap through the fixed opening defined by the second closed loop shape in the first direction, and the size of the second adjustable opening defined by the first loop shape may be configured to be increased by moving the second portion of the first strap through the fixed opening defined by the second closed loop shape in the second direction. The second direction may be opposite to the first direction.

The first strap may include nylon, cotton, polyester, and/or leather. Similarly, the second strap may include nylon, cotton, polyester, and/or leather.

The device may also include a flexible material that covers a section of the second portion of the first strap. The section of the second portion of the first strap may be adjacent to the first adjustable opening. The flexible material may include neoprene. A surface of the flexible material that faces the first adjustable opening may be smooth.

The second portion of the first strap may be integral with the third strap. The third closed loop shape may be configured to receive a connector. The connector may be a hook, a clip, and/or a carabiner.

The third closed loop shape may be formed by attaching the second portion of the first strap to a third portion of the first strap. The second closed loop shape may be secured by a stitching. The second closed loop shape may be secured by a metal snap fastener. The first adjustable opening may be configured to accommodate an appendage of a body when the first adjustable opening is adjusted to a minimum size.

According to another aspect of the invention, a method includes adjusting a first adjustable opening within a first loop shape of a first strap by changing a relative position of the first strap with respect to a fixed opening defined by a second closed loop shape of a second strap. A first portion of the first strap is attached to or integral with the second strap, a second portion of the first strap is arranged to be movable within the fixed opening defined by the second closed loop shape of the second strap, and adjusting the first adjustable opening comprises applying a force to a third closed loop shape that is affixed to or integral with the second portion of the first strap.

Adjusting the first adjustable opening may also include increasing a size of the first adjustable opening within the first loop shape of the first strap by moving the second portion of the first strap through the fixed opening defined by the second closed loop shape in a first direction. Adjusting the first adjustable opening may also include decreasing a size of the first adjustable opening within the first loop shape of the first strap by moving the second portion of the first strap through the fixed opening defined by the second closed loop shape in a second direction. The force may be applied through a connector that is connected to the third closed loop shape of the third strap.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Exemplary embodiments of the invention provide devices that isolate the muscle groups of a user during exercise. By isolating the stress of the exercise to the intended muscle group and alleviating the stress load of the weight on the forearms, elbows, and shoulder joints, the devices effectively eliminate the need to use the hands and forearms. Further, the devices eliminate the reliance on grip strength for performing the exercise.

Figure 1:
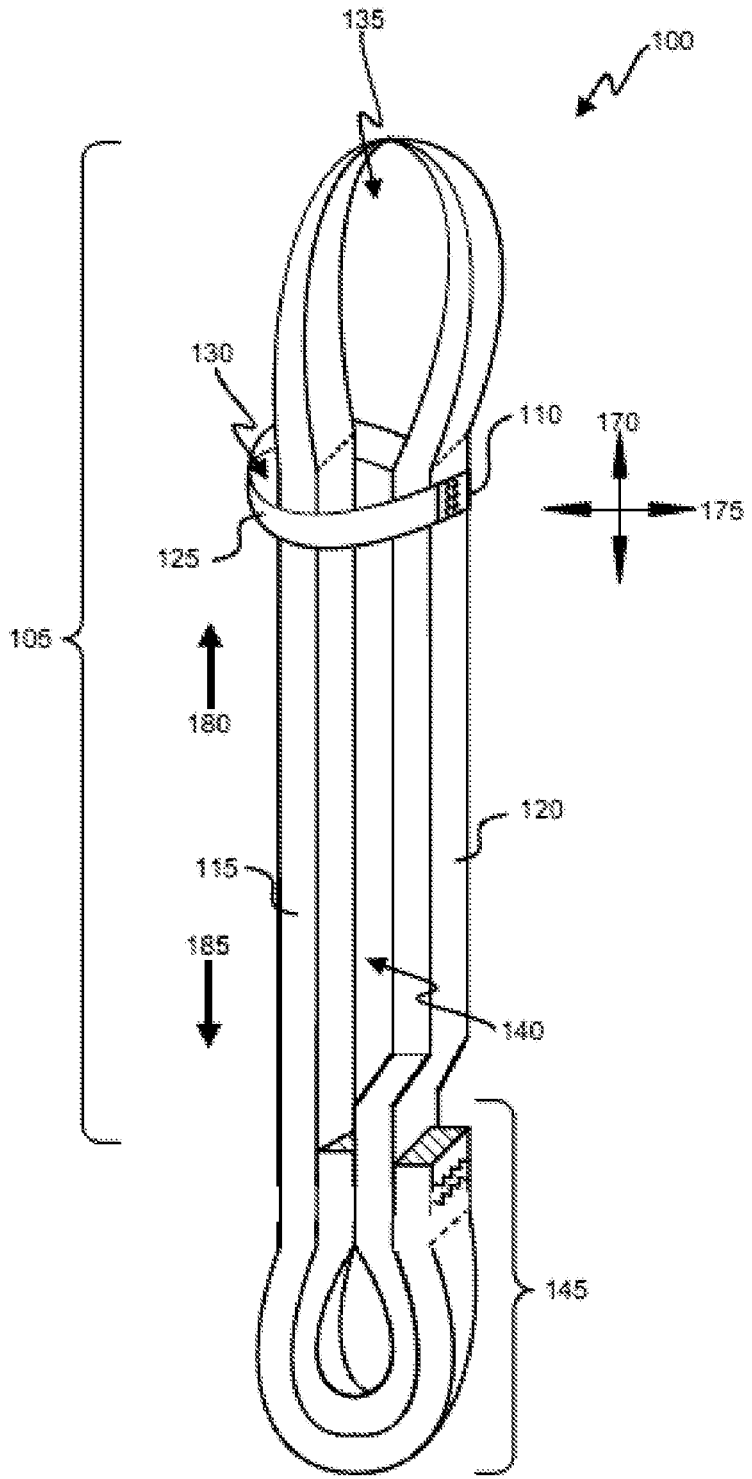
FIG. 1 shows an example of an exercise device according to exemplary embodiments of the invention.

FIG. 1 shows an example of an exercise device 100 according to exemplary embodiments of the invention. As shown in FIG. 1, the exercise device 100 includes a first strap 105 that has a first portion 110, a second portion 115, and a third portion 120. The first portion 110, the second portion 115, and the third portion 120 of the first strap 105 together form a first closed loop shape. The first strap 105 may be made of a flexible material, such as nylon, cotton, polyester, and/or leather. The flexible material may have sufficient strength to withstand a force that is applied while using the exercise device 100 to perform an exercise.

The first portion 110 of the first strap 105 may be affixed to a second strap 125 that forms a second closed loop shape. The first portion of the first strap 105 may be affixed to the second strap 125 by a fastener, such as stitching and/or glue. The fastener may extend over an entire vertical length of the second strap 125. The second portion 115 of the first strap 105 may extend from the top edge of the first portion 110 of the first strap 105 to a junction with a third strap 145. The third portion 120 of the first strap 105 may extend from the bottom edge of the first portion 110 of the first strap 105 to the junction with the third strap 145.

The second strap 125 may be made of a flexible material, such as nylon, cotton, polyester, and/or leather. The second closed loop shape of the second strap 125 may be secured by a fastener, such as stitching and/or a metal snap. For example, two ends of the second closed loop shape of the second strap 125 may be stitched together or held together by a metal snap with a male component on the first end of the second closed loop shape of the second strap 125 and a female component on the second end of the second closed loop shape of the second strap 125. Alternatively, any other fastener that is capable of fastening the first end of the second closed loop shape of the second strap 125 to the second end of the second closed loop shape of the second strap 125 may be used.

The second closed loop shape of the second strap 125 may define a fixed opening 130. Once the first end of the second closed loop shape of the second strap 125 has been affixed to the second end of the second closed loop shape of the second strap 125, the shape of the fixed opening 130 is constrained by the extent of the second closed loop shape of the second strap 125. Because the second strap 125 may be made of a flexible material, the shape of the fixed opening 130 may be altered somewhat by applying pressure to a portion of the second strap 125, such as by squeezing opposing portions of the second closed loop shape of the second strap 125 together. However, the basic shape and size of the fixed opening 130 may remain the same as determined by the length of the second closed loop shape of the second strap 125.

The second strap 125 may be affixed to the first portion 110 of the first strap 105 such that the second strap 125 is arranged in a plane that is generally perpendicular to a first axis 170, as shown in FIG. 1. The first axis 170 may be parallel to the vertical axis of the device 100. Alternatively, the second strap 125 may be affixed to the first portion 110 of the first strap 105 such that the second strap 125 is arranged in a plane that is generally perpendicular to a second axis 175 and parallel to the first axis 170.

The second portion 115 of the first strap 105 and the third portion 120 of the first strap 105 may be affixed to or integrated with the third strap 145, which forms a third closed loop shape. The second portion 115 of the first strap 105 and the third portion 120 of the first strap 105 may be affixed to the third strap 145 by fasteners, such as stitching and/or glue. The fasteners may extend over a portion of the vertical length of the third strap 145. Alternatively, the second portion 115 of the first strap 105 and/or the third portion 120 of the first strap 105 may form the third strap 145, as shown in FIG. 1.

The third strap 145 may be made of a flexible material, such as nylon, cotton, polyester, and/or leather. The flexible material may have sufficient strength to withstand a force that is applied while using the exercise device 100 to perform an exercise. The third closed loop shape of the third strap 145 may be secured by a fastener, such as stitching and/or a metal snap. For example, two ends of the third closed loop shape of the third strap 145 may be stitched together or held together by a metal snap with a male component on the first end of the third closed loop shape of the third strap 145 and a female component on the second end of the third closed loop shape of the third strap 145. Alternatively, any other fastener that is capable of fastening the first end of the third closed loop shape of the third strap 145 to the second end of the third closed loop shape of the third strap 145 may be used.

The third closed loop shape may be formed by attaching the second portion 115 of the first strap 105 to the third portion 120 of the first strap 105. For example, the end of the third portion 120 of the first strap 105 may be looped around and affixed to another section of the third portion 120 of the first strap 105 to form an inner portion of the third closed loop shape. Further, the end of the second portion 115 of the first strap 105 may be looped around and affixed to the third portion 120 of the first strap 105 to form an outer portion of the third closed loop shape that is adjacent to the inner portion of the third closed loop shape.

The second portion 115 of the first strap 105 may be threaded through the fixed opening 130 defined by the second closed loop shape of the second strap 125. The second portion 115 of the first strap 105 is not attached to the second strap 125. Instead, the second portion 115 of the first strap 105 is arranged to be movable within the fixed opening 130 defined by the second closed loop shape of the second strap 125.

The first loop shape of the first strap 105 may define a first adjustable opening 135 and a second adjustable opening 140. The size and shape of the first adjustable opening 135 and the second adjustable opening 140 may be adjusted by moving the second portion 115 of the first strap 105 with respect to the fixed opening 130 defined by the second closed loop shape of the second strap 125. Alternatively or in addition, the size and shape of the first adjustable opening 135 and the second adjustable opening 140 may be adjusted by moving the fixed opening 130 defined by the second closed loop shape of the second strap 125 with respect to the second portion 115 of the first strap 105. As the size of the first adjustable opening 135 increases, the size of the second adjustable opening 140 decreases proportionally. Similarly, as the size of the first adjustable opening 135 decreases, the size of the second adjustable opening 140 increases proportionally.

For example, the size of the first adjustable opening 135 may be increased by moving the second portion 115 of the first strap 105 through the fixed opening 130 defined by the second closed loop shape of the second strap 125 in a first direction 180. This causes a corresponding decrease in the size of the second adjustable opening 140.

Similarly, the size of the first adjustable opening 135 may be decreased by moving the second portion 115 of the first strap 105 through the fixed opening 130 defined by the second closed loop shape of the second strap 125 in a second direction 185 that is different from the first direction 180. This causes a corresponding increase in the size of the second adjustable opening 140. The second direction 185 may be opposite to the first direction 180. A force may be applied in the second direction 185 via the third closed loop shape of the third strap 145. For example, the force may adjust the size of the first adjustable opening 135 such that the portion of the first strap 105 defining the first adjustable opening 135 fits securely around an appendage of a user that has been inserted through the first adjustable opening 135.

The first adjustable opening 135 may be configured to accommodate an appendage of a user when the first adjustable opening 135 is adjusted to a minimum size. For example, the first adjustable opening 135 may be configured to accommodate a wrist, ankle, foot, or neck of the user. The length of the first strap 105 and/or the location of the first portion 110 of the first strap 105 where the second strap 125 is affixed may define a range of minimum sizes of the first adjustable opening 135. Because the first strap 105 can be made longer or shorter, and the location where the second strap 125 may be affixed to the first strap 105 can be varied, appendages having different sizes can be accommodated.

Figure 2:
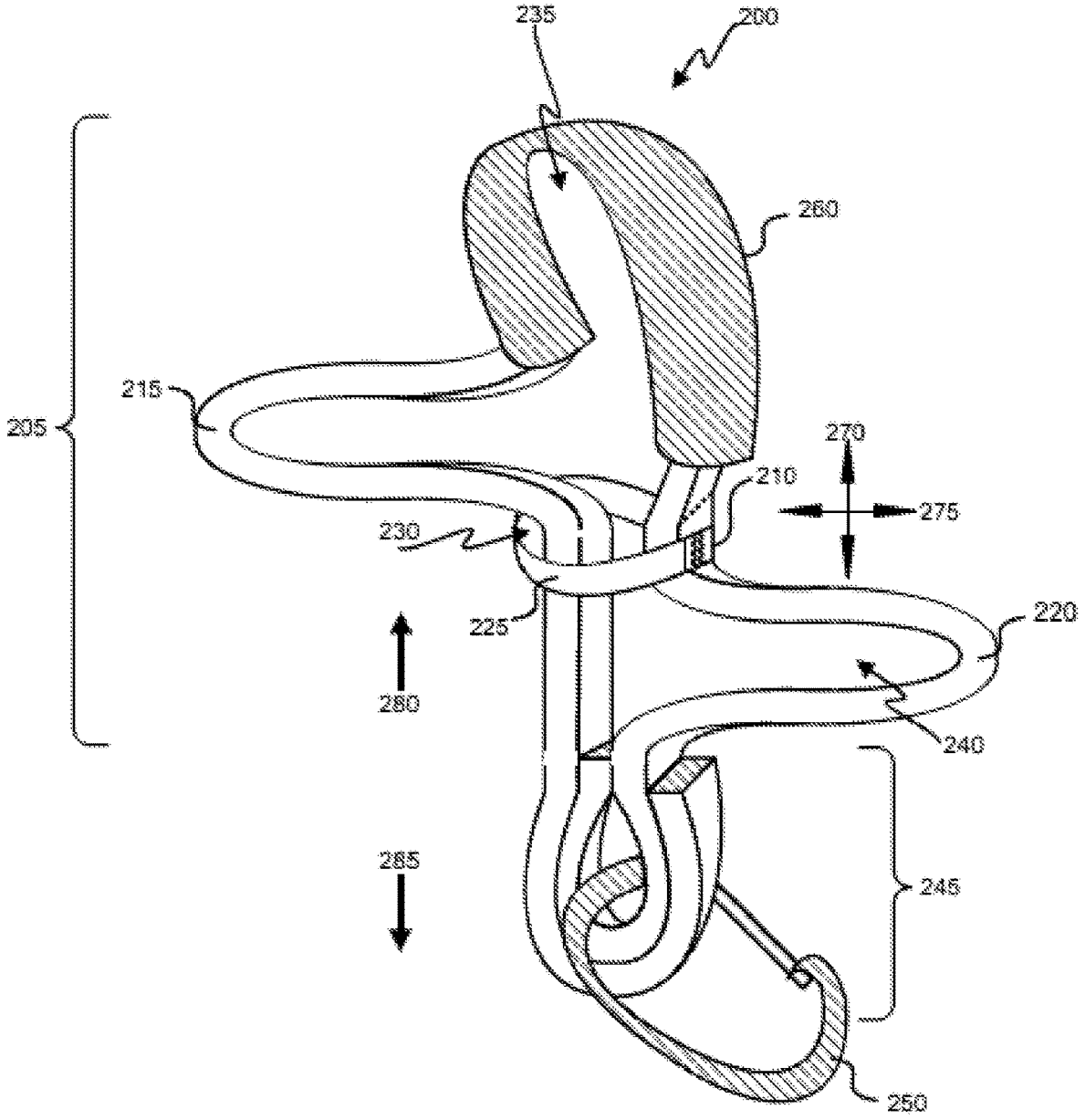
FIG. 2 shows an example of another exercise device according to exemplary embodiments of the invention.

FIG. 2 shows an example of another exercise device 200 according to exemplary embodiments of the invention. As shown in FIG. 2, the exercise device 200 includes a first strap 205 that has a first portion 210, a second portion 215, and a third portion 220. The first portion 210, the second portion 215, and the third portion 220 of the first strap 205 together form a first closed loop shape. The first strap 205 may be made of a flexible material, such as nylon, cotton, polyester, and/or leather. The flexible material may have sufficient strength to withstand a force that is applied while using the exercise device 200 to perform an exercise.

The first portion 210 of the first strap 205 may be affixed to a second strap 225 that forms a second closed loop shape. The first portion of the first strap 205 may be affixed to the second strap 225 by a fastener, such as stitching and/or glue. The fastener may extend over an entire vertical length of the second strap 225. The second portion 215 of the first strap 105 may extend from the top edge of the first portion 210 of the first strap 205 to a junction with a third strap 245. The third portion 220 of the first strap 205 may extend from the bottom edge of the first portion 210 of the first strap 205 to the junction with the third strap 245.

The second strap 225 may be made of a flexible material, such as nylon, cotton, polyester, and/or leather. The second closed loop shape of the second strap 225 may be secured by a fastener, such as stitching and/or a metal snap. For example, two ends of the second closed loop shape of the second strap 225 may be stitched together or held together by a metal snap with a male component on the first end of the second closed loop shape of the second strap 225 and a female component on the second end of the second closed loop shape of the second strap 225. Alternatively, any other fastener that is capable of fastening the first end of the second closed loop shape of the second strap 225 to the second end of the second closed loop shape of the second strap 225 may be used.

The second closed loop shape of the second strap 225 may define a fixed opening 230. Once the first end of the second closed loop shape of the second strap 225 has been affixed to the second end of the second closed loop shape of the second strap 225, the shape of the fixed opening 230 is constrained by the extent of the second closed loop shape of the second strap 225. Because the second strap 225 may be made of a flexible material, the shape of the fixed opening 230 may be altered somewhat by applying pressure to a portion of the second strap 225, such as by squeezing opposing portions of the second closed loop shape of the second strap 225 together. However, the basic shape and size of the fixed opening 230 may remain the same as determined by the length of the second closed loop shape of the second strap 225.

The second strap 225 may be affixed to the first portion 210 of the first strap 205 such that the second strap 225 is arranged in a plane that is generally perpendicular to a first axis 270, as shown in FIG. 2. The first axis 270 may be parallel to the vertical axis of the device 200. Alternatively, the second strap 225 may be affixed to the first portion 210 of the first strap 205 such that the second strap 225 is arranged in a plane that is generally perpendicular to a second axis 275 and parallel to the first axis 170.

The second portion 215 of the first strap 205 and the third portion 220 of the first strap 205 may be affixed to or integrated with the third strap 245, which forms a third closed loop shape. The second portion 215 of the first strap 205 and the third portion 220 of the first strap 205 may be affixed to the third strap 245 by fasteners, such as stitching and/or glue. The fasteners may extend over a portion of the vertical length of the third strap 245. Alternatively, the second portion 215 of the first strap 205 and/or the third portion 220 of the first strap 205 may form the third strap 245, as shown in FIG. 2. The third closed loop shape may be configured to receive a connector 250 such as a hook, clip, and/or carabiner. The connector 250 may be used to connect the exercise device 200 to exercise equipment such as dumbbells, barbells, plates, and/or chains.

The third strap 245 may be made of a flexible material, such as nylon, cotton, polyester, and/or leather. The flexible material may have sufficient strength to withstand a force that is applied while using the exercise device 200 to perform an exercise. The third closed loop shape of the third strap 245 may be secured by a fastener, such as stitching and/or a metal snap. For example, two ends of the third closed loop shape of the third strap 245 may be stitched together or held together by a metal snap with a male component on the first end of the third closed loop shape of the third strap 245 and a female component on the second end of the third closed loop shape of the third strap 245. Alternatively, any other fastener that is capable of fastening the first end of the third closed loop shape of the third strap 245 to the second end of the third closed loop shape of the third strap 245 may be used.

The third closed loop shape may be formed by attaching the second portion 215 of the first strap 205 to the third portion 220 of the first strap 205. For example, the end of the third portion 220 of the third strap 205 may be looped around and affixed to another section of the third portion 220 of the first strap 205 to form an inner portion of the third closed loop shape. Further, the end of the second portion 215 of the first strap 205 may be looped around and affixed to the third portion 220 of the first strap 205 to form an outer portion of the third closed loop shape that is adjacent to the inner portion of the third closed loop shape.

The second portion 215 of the first strap 205 may be threaded through the fixed opening 230 defined by the second closed loop shape of the second strap 225. The second portion 215 of the first strap 205 is not attached to the second strap 225. Instead, the second portion 215 of the first strap 205 is arranged to be movable within the fixed opening 230 defined by the second closed loop shape of the second strap 225.

The first loop shape of the first strap 205 may define a first adjustable opening 235 and a second adjustable opening 240. The size and shape of the first adjustable opening 235 and the second adjustable opening 240 may be adjusted by moving the second portion 215 of the first strap 205 with respect to the fixed opening 230 defined by the second closed loop shape of the second strap 225. Alternatively or in addition, the size and shape of the first adjustable opening 235 and the second adjustable opening 240 may be adjusted by moving the fixed opening 230 defined by the second closed loop shape of the second strap 225 with respect to the second portion 215 of the first strap 205. As the size of the first adjustable opening 235 increases, the size of the second adjustable opening 240 decreases proportionally. Similarly, as the size of the first adjustable opening 235 decreases, the size of the second adjustable opening 240 increases proportionally.

For example, the size of the first adjustable opening 235 may be increased by moving the second portion 215 of the first strap 205 through the fixed opening 230 defined by the second closed loop shape of the second strap 225 in a first direction 280. This causes a corresponding decrease in the size of the second adjustable opening 240.

Similarly, the size of the first adjustable opening 235 may be decreased by moving the second portion 215 of the first strap 205 through the fixed opening 230 defined by the second closed loop shape of the second strap 225 in a second direction 285 that is different from the first direction 280. This causes a corresponding increase in the size of the second adjustable opening 240. The second direction 285 may be opposite to the first direction 280. A force may be applied in the second direction 285 via the third closed loop shape of the third strap 245. For example, the force may adjust the size of the first adjustable opening 235 such that the portion of the first strap 205 defining the first adjustable opening 235 fits securely around an appendage of a user that has been inserted through the first adjustable opening 235. The force may be applied via the connector 250 that is connected to the third strap 245.

The first adjustable opening 235 may be configured to accommodate an appendage of a user when the first adjustable opening 235 is adjusted to a minimum size. For example, the first adjustable opening 235 may be configured to accommodate a wrist, ankle, foot, or neck of the user. The length of the first strap 205 and/or the location of the first portion 210 of the first strap 205 where the second strap 225 is affixed may define a range of minimum sizes of the first adjustable opening 235. Because the first strap 205 can be made longer or shorter, and the location where the second strap 225 may be affixed to the first strap 205 can be varied, appendages having different sizes can be accommodated.

As shown in FIG. 2, the exercise device 200 may include a flexible material 260 that covers a section of the second portion 215 of the first strap 205. The flexible material 260 may include a padded material such as neoprene, foam, and/or rubber. The flexible material 260 may cover a section of the second portion 215 of the first strap 205 that is adjacent to the first adjustable opening 235. For example, the flexible material 260 may extend along a section of the second portion 215 of the first strap 205 starting from the top of the first portion 210 of the first strap 205. Alternatively, the flexible material 260 may cover a larger portion or an entire length of the first strap 205, and may contain a slit (See FIGS. 7-16) through which the first strap 205 is threaded. The flexible material 260 may have a length that allows access to the third closed loop shape of the third strap 245. A surface of the flexible material 260 that faces the first adjustable opening 235 may be smooth.

The flexible material 260 may be affixed to the second portion 215 of the first strap 205 by a fastener, such as stitching and/or glue. The flexible material 260 may be affixed to the second portion 215 of the first strap 205 at a single location adjacent to the first portion 210 of the first strap 205. Alternatively or in addition, the flexible material 260 may be affixed to the second portion 215 of the first strap 205 at multiple locations.

Figure 3:
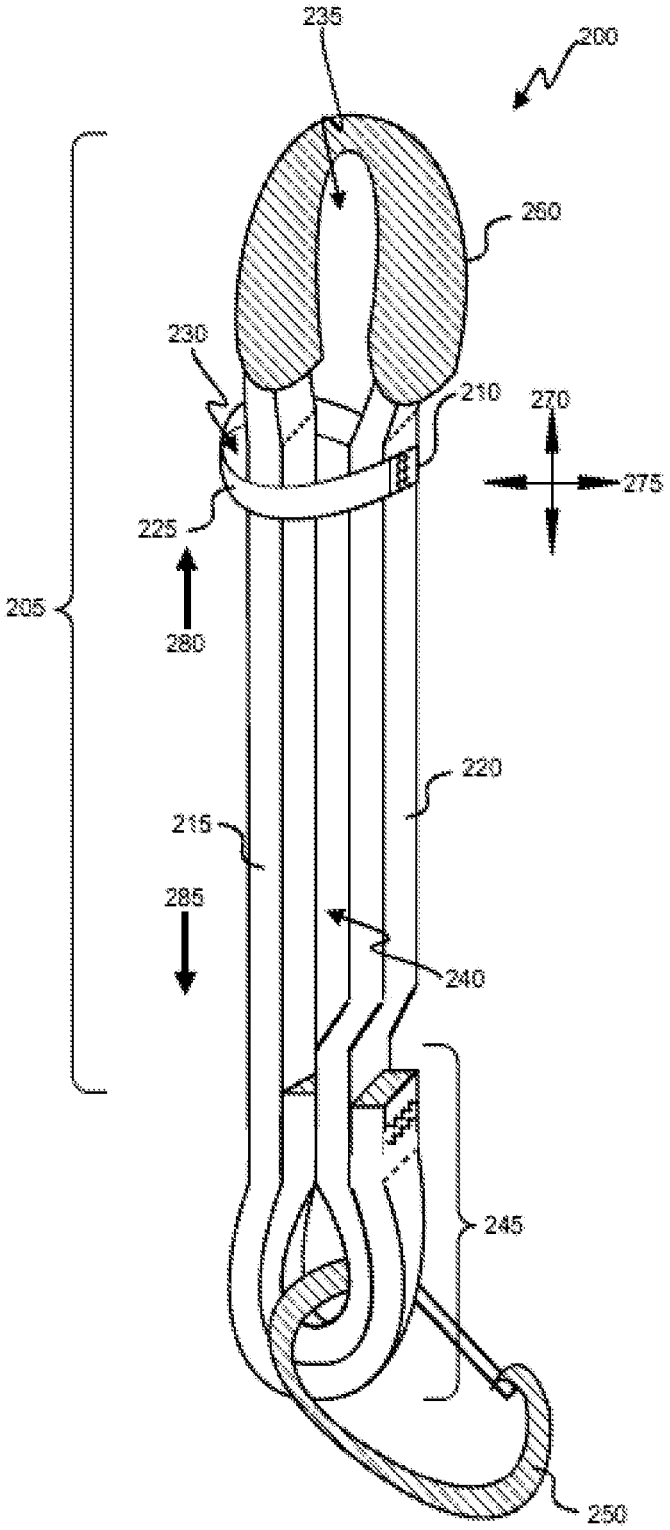
FIG. 3 shows an example of the exercise device of FIG. 2 in another configuration.

FIG. 3 shows an example of the exercise device 200 shown in FIG. 2 in another configuration. As shown in FIG. 3, the first adjustable opening 235 has a reduced size compared with the first adjustable opening 235 in FIG. 2. In addition, the second adjustable opening 240 has an increased size compared with the second adjustable opening 240 in FIG. 2. The first adjustable opening 235 may have been decreased by moving the second portion 215 of the first strap 205 through the fixed opening 230 defined by the second closed loop shape along the second direction 285. The second portion 215 of the first strap 205 may have been moved through the fixed opening 230 defined by the second closed loop shape along the second direction 285 by applying a force to the third closed loop shape of the third strap 245. Alternatively or in addition, the force may have been applied through the connector 250 that is connected to the third closed loop shape of the third strap 245.

Figure 4:
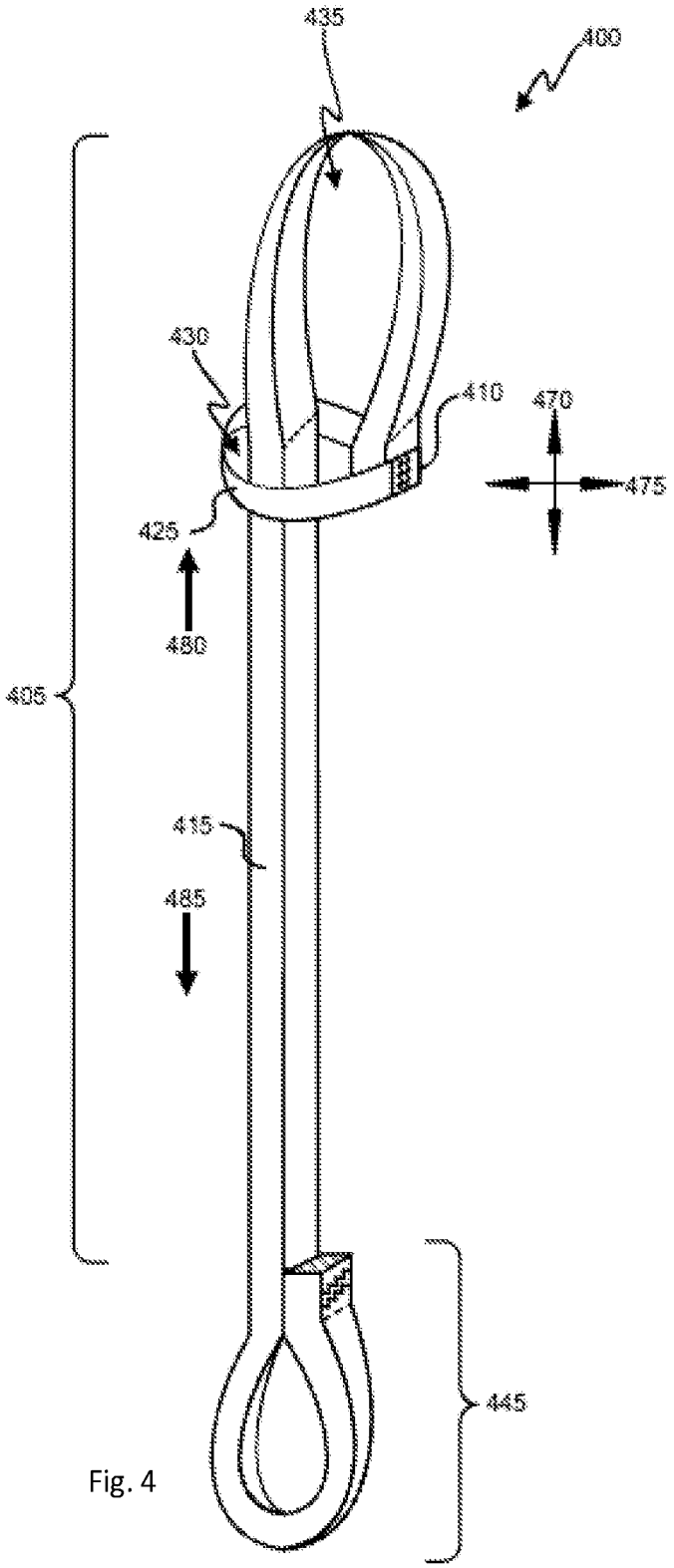
FIG. 4 shows an example of another exercise device according to exemplary embodiments of the invention.

FIG. 4 shows an example of another exercise device 400 according to exemplary embodiments of the invention. As shown in FIG. 4, the exercise device 400 includes a first strap 405 that has a first portion 410 and a second portion 415. The first portion 410 and/or the second portion 415 of the first strap 405 may form a first loop shape. The first loop shape may include an opening. The first strap 405 may be made of a flexible material, such as nylon, cotton, polyester, and/or leather. The flexible material may have sufficient strength to withstand a force that is applied while using the exercise device 400 to perform an exercise.

The first portion 410 of the first strap 405 may be affixed to a second strap 425 that forms a second closed loop shape, as shown in FIG. 4. The first portion of the first strap 405 may be affixed to the second strap 425 by a fastener, such as stitching and/or glue. The fastener may extend over an entire vertical length of the second strap 425. The second portion 415 of the first strap 405 may extend from the top edge of the first portion 410 of the first strap 405 to a junction with a third strap 445.

Alternatively, the first portion 410 of the first strap 405 may be integral with the second strap 425. In this example, the second strap 425 is a continuation of the first portion 410 of the first strap 405. The second closed loop shape may be formed by looping the end of the first portion 410 of the first strap 405 around the second portion 415 of the first strap 405, and affixing the end of the first portion 410 of the first strap 405 to another section of the first portion 410 of the first strap 405. Further, the end of the first portion 410 of the first strap 405 may be affixed to the other section of the first portion 410 of the first strap 405 by a fastener, such as stitching and/or glue.

The second strap 425 may be made of a flexible material, such as nylon, cotton, polyester, and/or leather. The second closed loop shape of the second strap 425 may be secured by a fastener, such as stitching and/or a metal snap. For example, two ends of the second closed loop shape of the second strap 425 may be stitched together or held together by a metal snap with a male component on the first end of the second closed loop shape of the second strap 425 and a female component on the second end of the second closed loop shape of the second strap 425. Alternatively, any other fastener that is capable of fastening the first end of the second closed loop shape of the second strap 425 to the second end of the second closed loop shape of the second strap 425 may be used.

The second closed loop shape of the second strap 425 may define a fixed opening 430. Once the first end of the second closed loop shape of the second strap 425 has been affixed to the second end of the second closed loop shape of the second strap 425, the shape of the fixed opening 430 is constrained by the extent of the second closed loop shape of the second strap 425. Because the second strap 425 may be made of a flexible material, the shape of the fixed opening 430 may be altered somewhat by applying pressure to a portion of the second strap 425, such as by squeezing opposing portions of the second closed loop shape of the second strap 425 together. However, the basic shape and size of the fixed opening 430 may remain the same as determined by the length of the second closed loop shape of the second strap 425.

The second strap 425 may be affixed to the first portion 410 of the first strap 405 such that the second strap 425 is arranged in a plane that is generally perpendicular to a first axis 470, as shown in FIG. 4. The first axis 470 may be parallel to the vertical axis of the device 400. Alternatively, the second strap 425 may be affixed to the first portion 410 of the first strap 405 such that the second strap 425 is arranged in a plane that is generally perpendicular to a second axis 475 and parallel to the first axis 470.

The second portion 415 of the first strap 405 may be affixed to or integrated with the third strap 445, which forms a third closed loop shape. The second portion 415 of the first strap 405 may be affixed to the third strap 445 by fasteners, such as stitching and/or glue. The fasteners may extend over a portion of the vertical length of the third strap 445. Alternatively, the second portion 415 of the first strap 405 may form the third strap 145, as shown in FIG. 1.

The third strap 445 may be made of a flexible material, such as nylon, cotton, polyester, and/or leather. The flexible material may have sufficient strength to withstand a force that is applied while using the exercise device 400 to perform an exercise. The third closed loop shape of the third strap 445 may be secured by a fastener, such as stitching and/or a metal snap. For example, two ends of the third closed loop shape of the third strap 445 may be stitched together or held together by a metal snap with a male component on the first end of the third closed loop shape of the third strap 445 and a female component on the second end of the third closed loop shape of the third strap 445. Alternatively, any other fastener that is capable of fastening the first end of the third closed loop shape of the third strap 445 to the second end of the third closed loop shape of the third strap 445 may be used.

The third closed loop shape may be formed by looping the end of the second portion 415 of the first strap 405 and affixing the end of the second portion 415 of the first strap 405 to another section of the second portion 415 of the first strap 405. Further, the end of the second portion 415 of the first strap 405 may be affixed to the other section of the second portion 415 of the first strap 405 by a fastener, such as stitching and/or glue.

The second portion 415 of the first strap 405 may be threaded through the fixed opening 430 defined by the second closed loop shape of the second strap 425. The second portion 415 of the first strap 405 is not attached to the second strap 425. Instead, the second portion 415 of the first strap 405 is arranged to be movable within the fixed opening 430 defined by the second closed loop shape of the second strap 425.

The first loop shape of the first strap 405 may define a first adjustable opening 435. The size and shape of the first adjustable opening 435 may be adjusted by moving the second portion 415 of the first strap 405 with respect to the fixed opening 430 defined by the second closed loop shape of the second strap 425. Alternatively or in addition, the size and shape of the first adjustable opening 435 may be adjusted by moving the fixed opening 430 defined by the second closed loop shape of the second strap 425 with respect to the second portion 415 of the first strap 405.

For example, the size of the first adjustable opening 435 may be increased by moving the second portion 415 of the first strap 405 through the fixed opening 430 defined by the second closed loop shape of the second strap 425 in a first direction 480. Similarly, the size of the first adjustable opening 435 may be decreased by moving the second portion 415 of the first strap 405 through the fixed opening 430 defined by the second closed loop shape of the second strap 425 in a second direction 485 that is different from the first direction 480. The second direction 485 may be the opposite direction of the first direction 480. A force may be applied in the second direction 485 via the third closed loop shape of the third strap 445. For example, the force may adjust the size of the first adjustable opening 435 such that the portion of the first strap 405 defining the first adjustable opening 435 fits securely around an appendage of a user that has been inserted through the first adjustable opening 435.

The first adjustable opening 435 may be configured to accommodate an appendage of a user when the first adjustable opening 435 is adjusted to a minimum size. For example, the first adjustable opening 435 may be configured to accommodate a wrist, ankle, foot, or neck of the user. The length of the first strap 405 and/or the location of the first portion 410 of the first strap 405 where the second strap 425 is affixed may define a range of minimum sizes of the first adjustable opening 435. Because the first strap 405 can be made longer or shorter, and the location where the second strap 425 may be affixed to the first strap 405 can be varied, appendages having different sizes can be accommodated.

Figure 5:
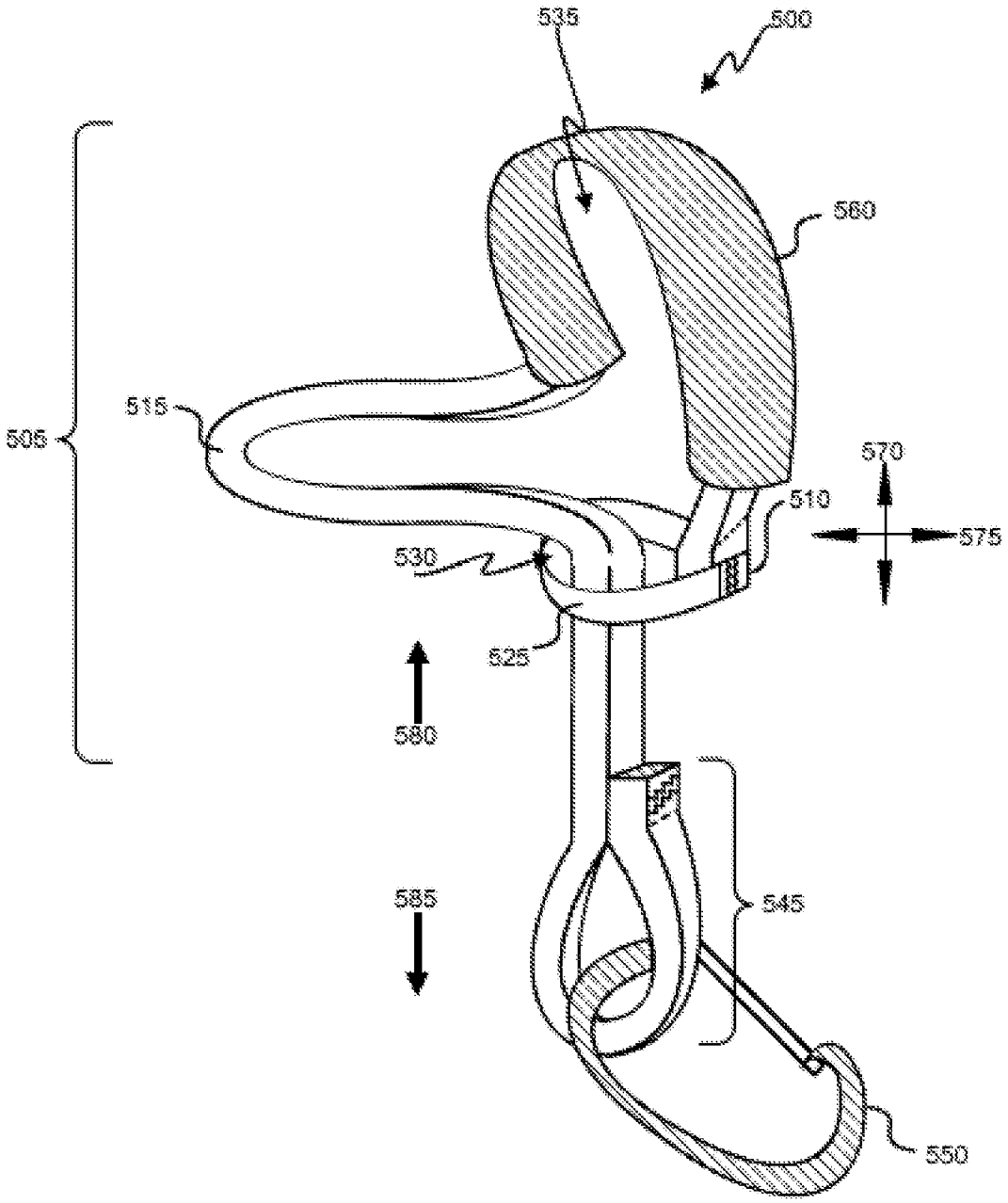
FIG. 5 shows an example of another exercise device according to exemplary embodiments of the invention.

FIG. 5 shows an example of another exercise device 500 according to exemplary embodiments of the invention. As shown in FIG. 5, the exercise device 500 includes a first strap 505 that has a first portion 510 and a second portion 515. The first portion 510 and/or the second portion 515 of the first strap 505 may form a first loop shape. The first loop shape may include an opening. The first strap 505 may be made of a flexible material, such as nylon, cotton, polyester, and/or leather. The flexible material may have sufficient strength to withstand a force that is applied while using the exercise device 500 to perform an exercise.

The first portion 510 of the first strap 505 may be affixed to a second strap 525 that forms a second closed loop shape, as shown in FIG. 5. The first portion of the first strap 505 may be affixed to the second strap 525 by a fastener, such as stitching and/or glue. The fastener may extend over an entire vertical length of the second strap 525. The second portion 515 of the first strap 505 may extend from the top edge of the first portion 510 of the first strap 505 to a junction with a third strap 545.

Alternatively, the first portion 510 of the first strap 505 may be integral with the second strap 525. In this example, the second strap 525 is a continuation of the first portion 510 of the first strap 505. The second closed loop shape may be formed by looping the end of the first portion 510 of the first strap 505 around the second portion 515 of the first strap 505, and affixing the end of the first portion 510 of the first strap 505 to another section of the first portion 510 of the first strap 505. Further, the end of the first portion 510 of the first strap 505 may be affixed to the other section of the first portion 510 of the first strap 505 by a fastener, such as stitching and/or glue.

The second strap 525 may be made of a flexible material, such as nylon, cotton, polyester, and/or leather. The second closed loop shape of the second strap 525 may be secured by a fastener, such as stitching and/or a metal snap. For example, two ends of the second closed loop shape of the second strap 525 may be stitched together or held together by a metal snap with a male component on the first end of the second closed loop shape of the second strap 525 and a female component on the second end of the second closed loop shape of the second strap 525. Alternatively, any other fastener that is capable of fastening the first end of the second closed loop shape of the second strap 525 to the second end of the second closed loop shape of the second strap 525 may be used.

The second closed loop shape of the second strap 525 may define a fixed opening 530. Once the first end of the second closed loop shape of the second strap 525 has been affixed to the second end of the second closed loop shape of the second strap 525, the shape of the fixed opening 530 is constrained by the extent of the second closed loop shape of the second strap 525. Because the second strap 525 may be made of a flexible material, the shape of the fixed opening 530 may be altered somewhat by applying pressure to a portion of the second strap 525, such as by squeezing opposing portions of the second closed loop shape of the second strap 525 together. However, the basic shape and size of the fixed opening 530 may remain the same as determined by the length of the second closed loop shape of the second strap 525.

The second strap 525 may be affixed to the first portion 510 of the first strap 505 such that the second strap 525 is arranged in a plane that is generally perpendicular to a first axis 570, as shown in FIG. 5. The first axis 570 may be parallel to the vertical axis of the device 500. Alternatively, the second strap 525 may be affixed to the first portion 510 of the first strap 505 such that the second strap 525 is arranged in a plane that is generally perpendicular to a second axis 575 and parallel to the first axis 570.

The second portion 515 of the first strap 505 may be affixed to or integrated with the third strap 545, which forms a third closed loop shape. The second portion 515 of the first strap 505 may be affixed to the third strap 545 by fasteners, such as stitching and/or glue. The fasteners may extend over a portion of the vertical length of the third strap 545. Alternatively, the second portion 515 of the first strap 505 may form the third strap 545, as shown in FIG. 5. The third closed loop shape may be configured to receive a connector 550 such as a hook, clip, and/or carabiner. The connector 550 may be used to connect the exercise device 500 to exercise equipment such as a resistance band, dumbbells, barbells, plates, and/or chains.

The third strap 545 may be made of a flexible material, such as nylon, cotton, polyester, and/or leather. The flexible material may have sufficient strength to withstand a force that is applied while using the exercise device 500 to perform an exercise. The third closed loop shape of the third strap 545 may be secured by a fastener, such as stitching and/or a metal snap. For example, two ends of the third closed loop shape of the third strap 545 may be stitched together or held together by a metal snap with a male component on the first end of the third closed loop shape of the third strap 545 and a female component on the second end of the third closed loop shape of the third strap 545. Alternatively, any other fastener that is capable of fastening the first end of the third closed loop shape of the third strap 545 to the second end of the third closed loop shape of the third strap 545 may be used.

The third closed loop shape may be formed by looping the end of the second portion 515 of the first strap 505 and affixing the end of the second portion 515 of the first strap 505 to another section of the second portion 515 of the first strap 505. Further, the end of the second portion 515 of the first strap 505 may be affixed to the other section of the second portion 515 of the first strap 505 by a fastener, such as stitching and/or glue.

The second portion 515 of the first strap 505 may be threaded through the fixed opening 530 defined by the second closed loop shape of the second strap 525. The second portion 515 of the first strap 505 is not attached to the second strap 525. Instead, the second portion 515 of the first strap 505 is arranged to be movable within the fixed opening 530 defined by the second closed loop shape of the second strap 525.

The first loop shape of the first strap 505 may define a first adjustable opening 535. The size and shape of the first adjustable opening 535 may be adjusted by moving the second portion 515 of the first strap 505 with respect to the fixed opening 530 defined by the second closed loop shape of the second strap 525. Alternatively or in addition, the size and shape of the first adjustable opening 535 may be adjusted by moving the fixed opening 530 defined by the second closed loop shape of the second strap 525 with respect to the second portion 515 of the first strap 505.

For example, the size of the first adjustable opening 535 may be increased by moving the second portion 515 of the first strap 505 through the fixed opening 530 defined by the second closed loop shape of the second strap 525 in a first direction 580. Similarly, the size of the first adjustable opening 535 may be decreased by moving the second portion 515 of the first strap 505 through the fixed opening 530 defined by the second closed loop shape of the second strap 525 in a second direction 585 that is different from the first direction 580. The second direction 585 may be the opposite direction of the first direction 580. A force may be applied in the second direction 585 via the third closed loop shape of the third strap 545. For example, the force may adjust the size of the first adjustable opening 535 such that the portion of the first strap 505 defining the first adjustable opening 535 fits securely around an appendage of a user that has been inserted through the first adjustable opening 535.

The first adjustable opening 535 may be configured to accommodate an appendage of a user when the first adjustable opening 535 is adjusted to a minimum size. For example, the first adjustable opening 535 may be configured to accommodate a wrist, ankle, foot, or neck of the user. The length of the first strap 505 and/or the location of the first portion 510 of the first strap 505 where the second strap 525 is affixed may define a range of minimum sizes of the first adjustable opening 535. Because the first strap 505 can be made longer or shorter, and the location where the second strap 525 may be affixed to the first strap 505 can be varied, appendages having different sizes can be accommodated.

As shown in FIG. 5, the exercise device 500 may include a flexible material 560 that covers a section of the second portion 515 of the first strap 505. The flexible material 560 may include a padded material such as neoprene, foam, and/or rubber. The flexible material 560 may cover a section of the second portion 515 of the first strap 505 that is adjacent to the first adjustable opening 535. For example, the flexible material 560 may extend along a section of the second portion 515 of the first strap 505 starting from the top of the first portion 510 of the first strap 505. Alternatively, the flexible material 560 may cover a larger portion or an entire length of the first strap 505, and may contain a slit (see the embodiments of FIGS. 7-16) through which the first strap 505 is threaded. The flexible material 560 may have a length that allows access to the third closed loop shape of the third strap 545. A surface of the flexible material 560 that faces the first adjustable opening 535 may be smooth.

The flexible material 560 may be affixed to the second portion 515 of the first strap 505 by a fastener, such as stitching and/or glue. The flexible material 560 may be affixed to the second portion 515 of the first strap 505 at a single location adjacent to the first portion 510 of the first strap 505. Alternatively or in addition, the flexible material 560 may be affixed to the second portion 515 of the first strap 505 at multiple locations.

Figure 6:
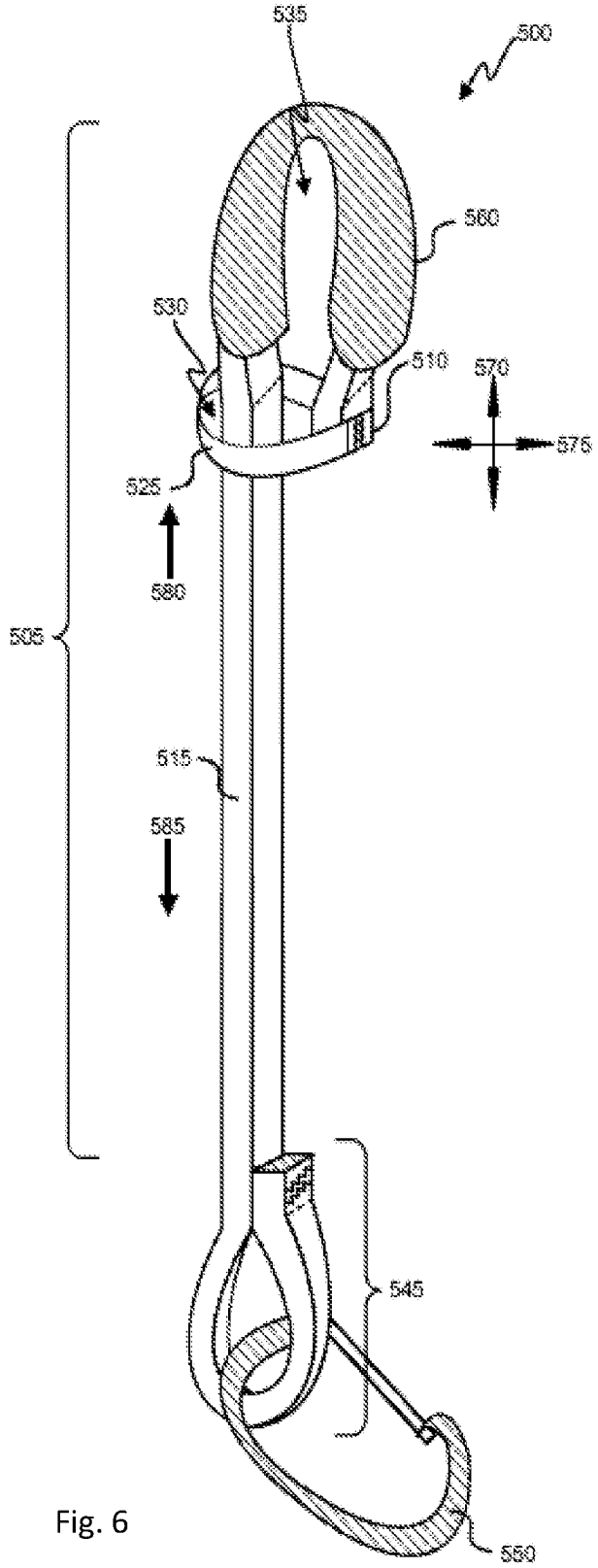
FIG. 6 shows an example of the exercise device of FIG. 5 in another configuration.

FIG. 6 shows an example of the exercise device 500 shown in FIG. 5 in another configuration. As shown in FIG. 6, the first adjustable opening 535 has a reduced size compared with the first adjustable opening 535 in FIG. 6. The first adjustable opening 535 may have been decreased by moving the second portion 515 of the first strap 505 through the fixed opening 530 defined by the second closed loop shape along the second direction 585. The second portion 515 of the first strap 505 may have been moved through the fixed opening 530 defined by the second closed loop shape along the second direction 585 by applying a force to the third closed loop shape of the third strap 545. Alternatively or in addition, the force may have been applied through the connector 550 that is connected to the third closed loop shape of the third strap 545.

Figure 7:
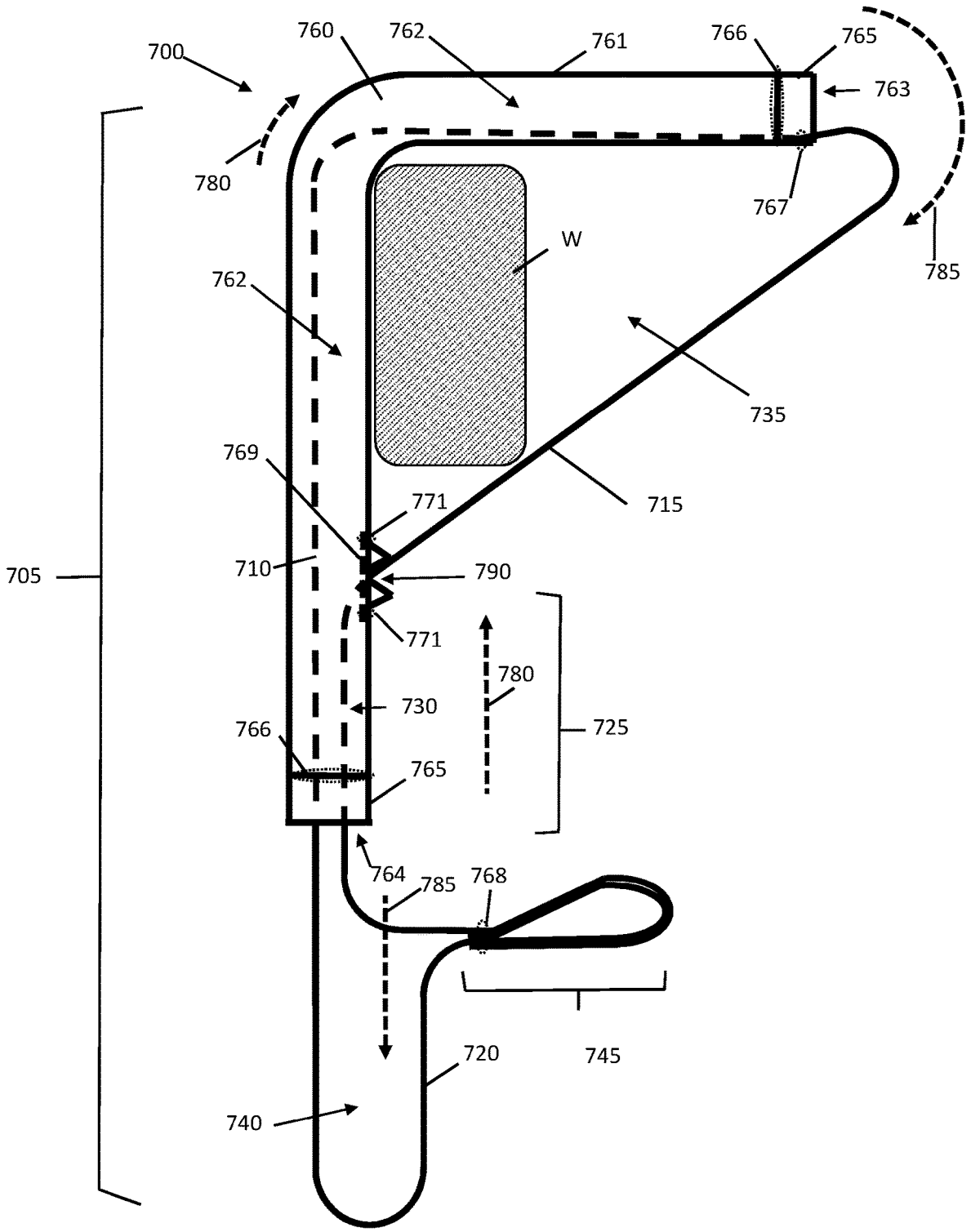
FIG. 7 shows an example of exemplary embodiments of an exercise device.

FIGS. 7-13 show more variations of another exercise device 700 according to exemplary embodiments of the invention. As shown in FIG. 7, the exercise device 700 includes a first strap 705 that has a first portion 710, a second portion 715, and a third portion 720. First portion 710, second portion 715, and third portion 720 of first strap 705 together form a first closed loop shape. First strap 705 may be made of a flexible material, such as nylon, cotton, polyester, and/or leather. The flexible material is typically made to have a sufficient strength to withstand a force that is applied while using the exercise device 700 to perform an exercise.

As shown in FIG. 7, the exercise device 700 may include a flexible material 760 that covers a section of second portion 715 of first strap 705. Flexible material 760 may include a padded material such as neoprene, foam, and/or rubber. Flexible material 760 may define a tube 761 with an open internal channel 762 between a first major opening 763 and a second major opening 764. Tube 761 may be formed by sewing together the long ends (793, 794 in FIGS. 11 and 12) of a rectangular piece of material and may include a pair of cuffs 765 attached, for example by being sewn on with threads 766, at each of the major openings 763, 764. Flexible material 760 may cover a section of second portion 715 of the first strap 705 that is adjacent to a first adjustable opening 735, into which a user may insert a wrist W.

Figure 8:
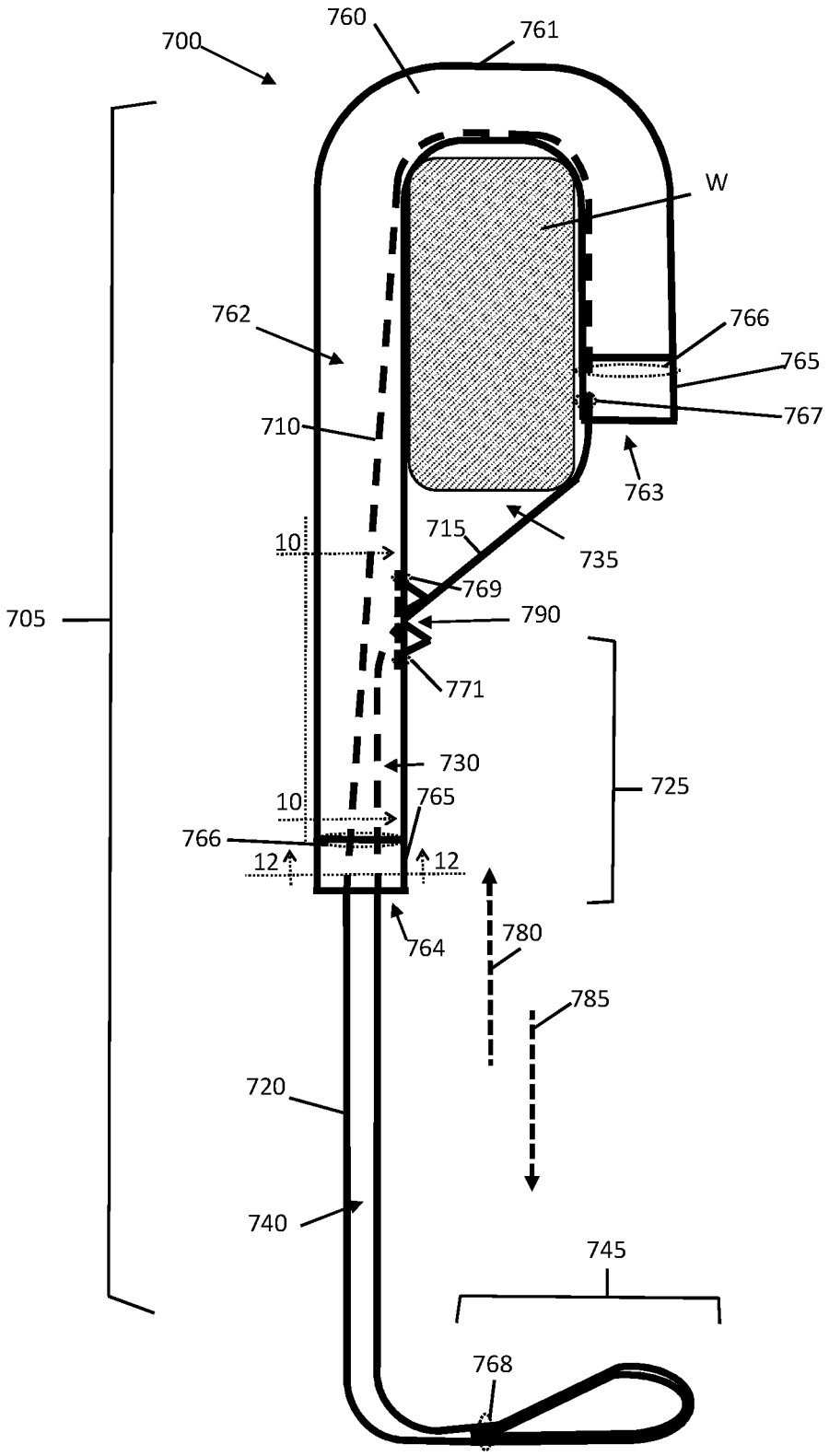
FIG. 8 shows an example of the exercise device of FIG. 7 with an adjustable loop in a tightened configuration.
Figure 9:
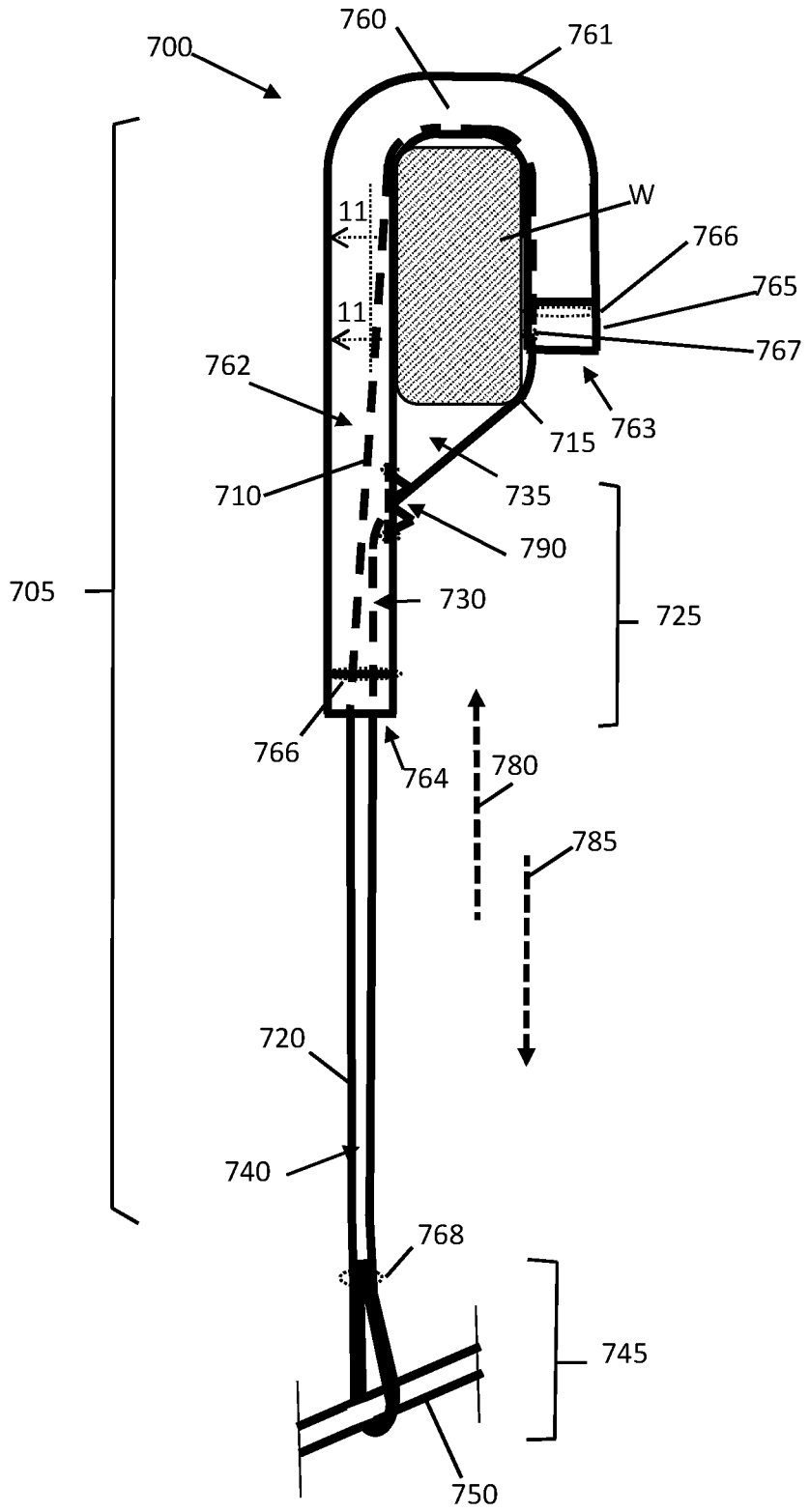
FIG. 9 shows an example of the exercise device of FIG. 8 with a carabiner attached to a fixed loop for coupling an end of the exercise device to another device, such as a resistance band or an anchor.

Similar to the coverage and the slit described above for flexible material 260 and 560, flexible material 760 may cover a larger portion or an entire length of first strap 705, and may contain a slit 790 through which the first strap 705 is threaded. For example as seen in FIGS. 7-9, first portion 710 of first strap 705 may extend through tube 761, including through both major openings 763, 764 and first strap 705 may be doubled back at second portion 715 toward tube 761. Second portion 715 of strap 705 may be threaded through slit 790 and extend within tube 761 and out through major opening 764 of tube 761. Strap 705 may be freely movable within tube 761 or may be coupled at one or more locations to tube 761. For example, second portion 715 of strap 705 may be attached or otherwise coupled to flexible material 760 at or adjacent first major opening 763 of tube 761, e.g., by a sewn attachment with threads 767.

Flexible material 760 may be at least partially movably disposed over second portion 715 of first strap 705. For example, as noted above, second portion 715 may be attached to flexible material 760 at or adjacent major opening 763, and freely movable with respect to slit 790 and major opening 764, which allows the movement of second portion 715 through slit 790 and opening 764 to tighten and loosen adjustable opening 735.

Flexible material 760 may include a portion 725 extending from slit 790 to adjacent opening 764 that forms a second closed loop shape. In this embodiment the second closed loop shape is typically provided by a portion of flexible material 760 and may be provided by a looped strap, a ring, a buckle, or similar structure as in other embodiments (see also FIGS. 13 and 14).

The second closed loop shape of portion 725 of flexible material 760 may define a fixed opening 730. Portion 725 of flexible material 760 may be an integral portion of flexible material 760, as illustrated in FIG. 7, or may be added on, e.g., by adding an external sleeve of material or another substantially-closed loop shape, such as a D-ring or a buckle made of a suitable material such as plastic or metal (e.g., FIGS. 13 and 14).

Second portion 715 of first strap 705 and third portion 720 of the first strap 705 may be affixed together or may be integrated with another strap to form a third closed loop shape 745. If a third strap is used, second portion 715 of first strap 705 and third portion 720 of first strap 705 may be affixed to the third strap by fasteners, such as stitching and/or glue. The fasteners may extend over a portion of the vertical length of the third strap. Alternatively, second portion 715 of first strap 705 and/or third portion 720 of the first strap 705 may form third closed loop shape 745, as shown in FIG. 7. For example, an end of second portion 715 may overlap an end of third portion 720 and be sewn with threads 768 or otherwise affixed together to form third closed loop shape 745.

As shown in FIG. 9, third closed loop shape 745 may be configured to receive a connector 750 such as a hook, clip, and/or carabiner. The connector 750 may be used to connect the exercise device 700 to exercise equipment such as a resistance band, dumbbells, barbells, plates, and/or chains.

The strap forming third closed loop shape 745 may be made of a flexible material, such as nylon, cotton, polyester, and/or leather. The flexible material may have sufficient strength to withstand a force that is applied while using the exercise device 700 to perform an exercise. Third closed loop shape 745 may be secured by a fastener 768, such as stitching and/or a metal snap. For example, two ends of the strap of third closed loop shape 745 may be stitched together or held together by a metal snap with a male component on the first end of the third closed loop shape of the third strap and a female component on the second end of the third closed loop shape of the third strap. Alternatively, any other fastener that is capable of fastening the first end of the strap of third closed loop shape 745 to the second end of the strap of third closed loop shape 745 may be used.

Second portion 715 of first strap 705 may be threaded through fixed opening 730 defined by the second closed loop shape of portion 725 of flexible material 760. Second portion 715 of first strap 705 is typically not attached to portion 725 of flexible material 760. Instead, second portion 715 of the first strap 705 may be arranged to be movable within the fixed opening 730 defined by the second closed loop shape of portion 725 of flexible material 760.

A first loop shape of first strap 705 may be provide by first portion 710, second portion 720, and third portion 720, and the first loop shape may include a first adjustable opening 735 and a second adjustable opening 740, as best seen in FIG. 7. The size and shape of first adjustable opening 735 and second adjustable opening 740 may be adjusted by moving second portion 715 of first strap 705 with respect to fixed opening 730 defined by the second closed loop shape of the portion 725 of flexible material 760. Alternatively or in addition, the size and shape of first adjustable opening 735 and second adjustable opening 740 may be adjusted by moving fixed opening 730 defined by the second closed loop shape of the portion 725 of flexible material 760 with respect to the second portion 715 of the first strap 705. Typically, as the size, for example the perimeter, of first adjustable opening 735 increases, the size, for example the perimeter, of the second adjustable opening 740 decreases proportionally. Expressed another way, as the portions of strap 705 providing first adjustable opening 735 increase, the portions of strap 705 providing second adjustable opening 740 decrease. Similarly, as the size of the first adjustable opening 735 decreases, the size of the second adjustable opening 740 increases proportionally, and as the portions of strap 705 providing first adjustable opening 735 decrease, the portions of strap 705 providing second adjustable opening 740 increase.

For example, the perimeter of first adjustable opening 735 may be increased by moving second portion 715 of first strap 705 through fixed opening 730 defined by the second closed loop shape of portion 725 of flexible material 760 in a first direction 780. This causes a corresponding decrease in the perimeter of second adjustable opening 740.

Similarly, the perimeter of first adjustable opening 735 may be decreased by moving second portion 715 of first strap 705 through fixed opening 730 defined by second closed loop shape of the portion 725 of flexible material 760 in a second direction 785 that is different from the first direction 780. This causes a corresponding increase in the perimeter of second adjustable opening 740. Second direction 785 may be opposite to first direction 780. A force may be applied in second direction 785 via the third closed loop shape 745. For example, the force may adjust the size and shape of first adjustable opening 735 such that the portion of first strap 705 defining first adjustable opening 735 fits securely around an appendage of a user, for example wrist W, that has been inserted through the first adjustable opening 735. The force may be applied via the connector 750 that is connected to the third strap, typically to provide a movement of connector 750 and strap 705 relative to one another.

First adjustable opening 735 may be configured to accommodate an appendage of a user when first adjustable opening 735 is adjusted to a smaller or a minimum size. For example, first adjustable opening 735 may be configured to accommodate a wrist, ankle, foot, or neck of the user. The length of first strap 705 and/or the location of the first portion 710 of the first strap 705, where the portion 725 of flexible material 760 may be positioned, may define a range of smaller or minimum sizes of first adjustable opening 735. Because first strap 705 may be made longer or shorter, and the location where portion 725 of flexible material 760 may be positioned on first strap 705 can be varied, appendages having different sizes can be accommodated.

FIGS. 8 and 9 show an example of the exercise device 700 shown in FIG. 7 in another configuration. As shown in FIGS. 8 and 9, first adjustable opening 735 has a reduced perimeter compared with first adjustable opening 735 in FIG. 7. In addition, second adjustable opening 740 has an increased perimeter compared with second adjustable opening 740 in FIG. 7. First adjustable opening 735 may have been decreased by moving second portion 715 of first strap 705 through fixed opening 730 defined by the second closed loop shape along second direction 785. Second portion 715 of the first strap 705 may have been moved through the fixed opening 730 defined by the second closed loop shape along the second direction 785 by applying a force to third closed loop shape 745 relative to tube 761. Alternatively or in addition, the force may have been applied through connector 750 that may be connected to third closed loop shape 745 (see FIG. 9).

Figure 10:
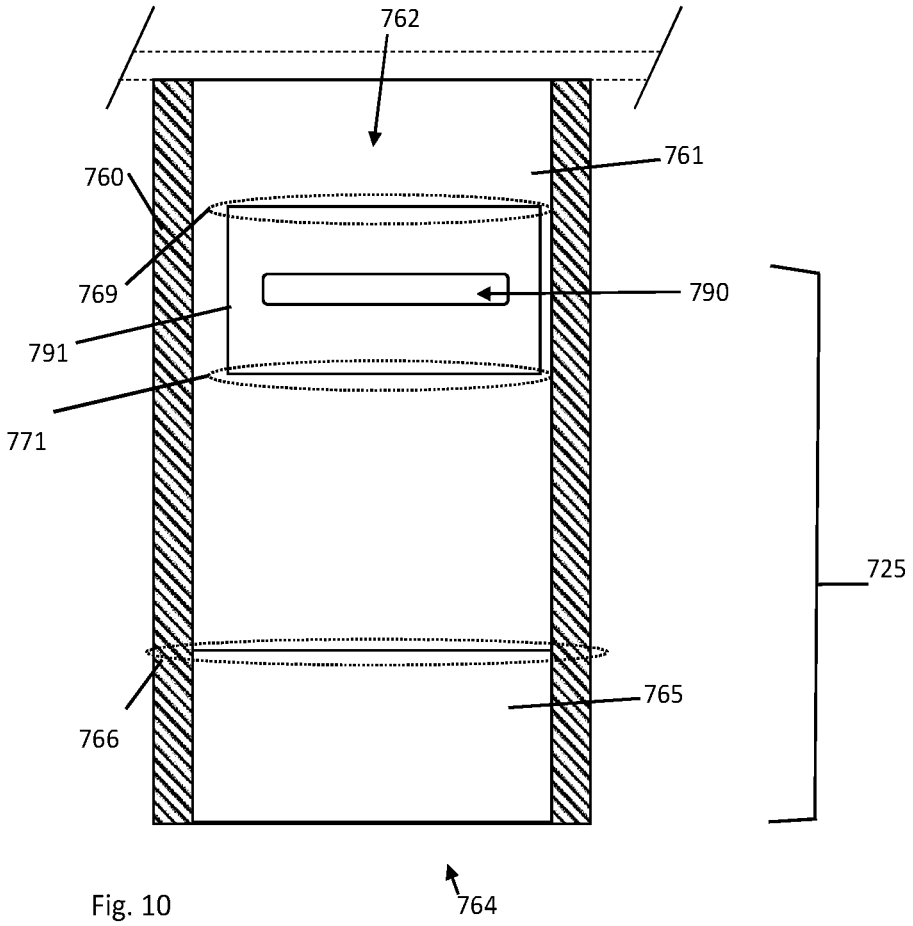
FIG. 10 shows an internal view within a channel in a tube of flexible material, looking from within the tube, at the location indicated by the 10-10 arrow points in FIG. 8, at a slit where a shield is attached to the flexible material.

An internal view within channel 762 of tube 761 of flexible material 760, looking at slit 790 from within the tube, is shown in FIG. 10. A shield or other reinforcement, such as a flat plastic shield 791 may be attached to flexible material 760 at slit 790, for example by being stitched into place by threads 769 and 771. Shield 791 may provide additional strength to flexible material 760 adjacent slit 790 and may provide a low-friction opening through which strap 705 may slide.

Figure 11:
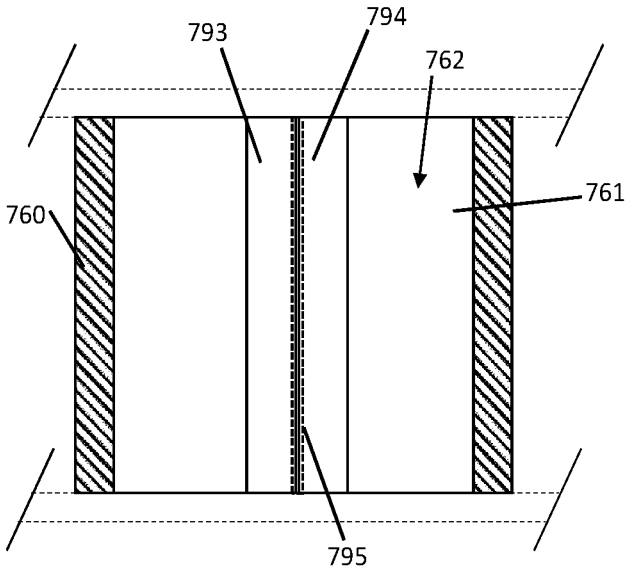
FIG. 11 is another internal view within the channel looking in the opposite direction as for FIG. 10 from within the tube, at the location indicated by the 11-11 arrow points in FIG. 9, and showing ends of a rectangular piece of the flexible material stitched together.

FIG. 11 is another internal view within channel 762, showing a portion of tube 761 of flexible material 760, in this case looking in the opposite direction as for FIG. 10 from within the tube. As described above, tube 761 may be formed by attaching together long ends 793 and 794 of a rectangular piece of flexible material 760. Ends 793, 794 may be attached by stitching as shown by threads 795. Ends 793, 794 may be stitched together either inside or outside of channel 762, and when stitched within, provide a clean, uniform appearance for an outer surface of tube 761 and may additionally provide a resilient portion within channel 762 to provide a friction fit on strap 705 allowing for controlled movement of strap 705 within channel 762.

Figure 12:
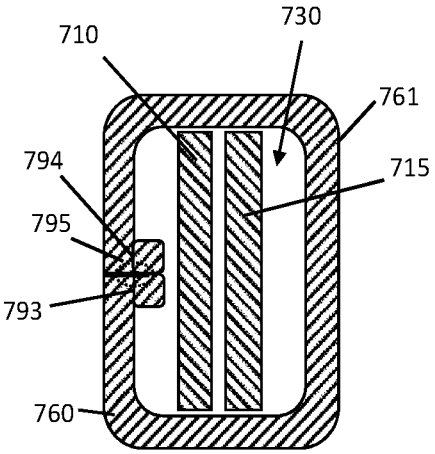
FIG. 12 is a cross-sectional view of the tube of flexible material, at the location indicated by the 12-12 arrow points in FIG. 8, of the tube and its seam, and the sections of strap within the tube.

FIG. 12 is a cross-sectional view of tube 761 of flexible material 760, at the location indicated by the 12-12 arrow points in FIG. 8. Tube 761 may be formed of a flat piece of flexible material 761 by stitching together ends 793, 794 at a seam formed by threads 795. First portion 710 and second portion 715 of strap 705 are in place within tube 761 in fixed opening 730.

As illustrated by the various embodiments described above, the present disclosure encompasses a variety of structural configurations for forming an adjustable opening to enclose an appendage of a user, such as wrist W. For example, fixed openings 130, 230, 430, 530, and 730 provide various structures for the opening, through which a portion of the strap may be movably positioned to provide for adjustment of the size or perimeter of adjustable openings 135, 235, 435, 535, and 735. Thus, the present disclosure will be understood to encompass any means of providing an opening, preferably an opening that is fixed in size and fixed in position relative to first portion 110, 210, 410, 510, or 710 of the strap and receiving second portion 115, 215, 415, 515, or 715 of the strap. Openings 130, 230, 430, 530, and 730 may thereby provide for relative movement therethrough of second portion 115, 215, 415, 515, or 715 of the strap for adjustment of the perimeter of opening 135, 235, 435, 535, or 735 to tighten and loosen the strap on the user's appendage, such as wrist W. Openings 130, 230, 430, 530, and 730 may be provided by an additional strap or by an opening in the flexible material or by any other structure, e.g., a D-ring or a buckle affixed or at least constrained in movement at a suitable location on the strap or the flexible material.

Figure 13:
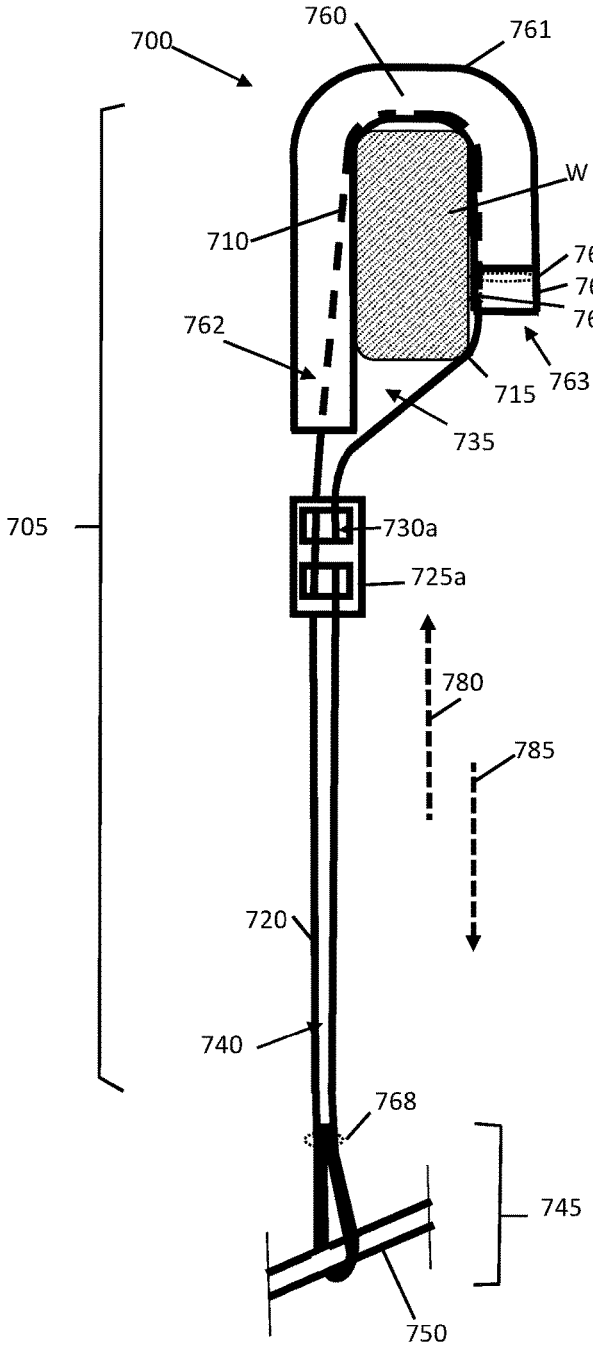
FIG. 13 is an alternative embodiment similar to FIG. 7, in this case providing a buckle coupled to the strap to provide a fixed opening.
Figure 14:
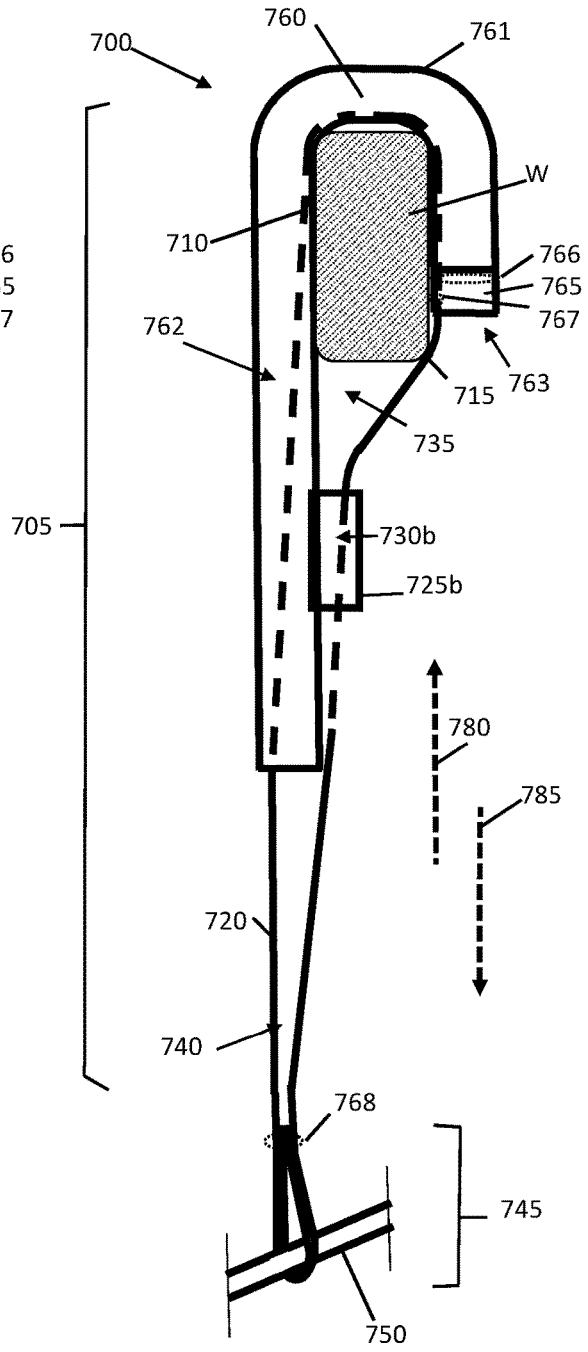
FIG. 14 is an alternative embodiment similar to FIG. 7, in this case providing a ring or a sleeve coupled to the flexible material to provide a fixed opening.
Figure 15:
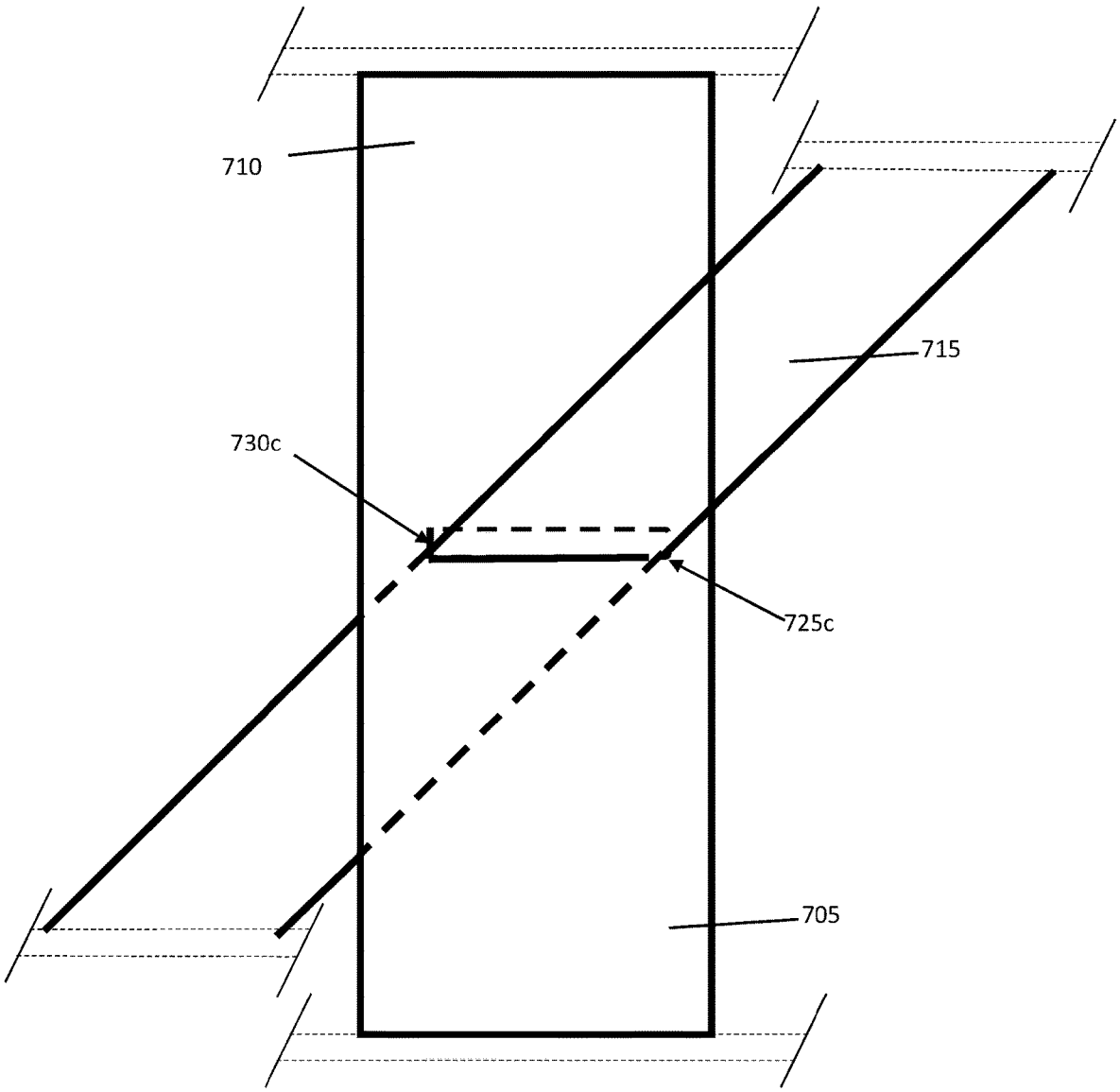
FIG. 15 is an alternative embodiment similar to FIG. 7, in this case providing a slot through the strap to provide a fixed opening.

Additional exemplary configurations for a buckle 725*a* coupled to strap 705, or a ring or a sleeve 725*b* coupled to strap 705, or a slot 725*c* in strap 705 are illustrated in FIGS. 13, 14, and 15. These configurations provide fixed openings 730*a*, 730*b*, or 730*c* for movement of strap portion 715 therethrough for adjustment of opening 735 for tightening or loosening on user's appendage, such as wrist W.

Figure 16:
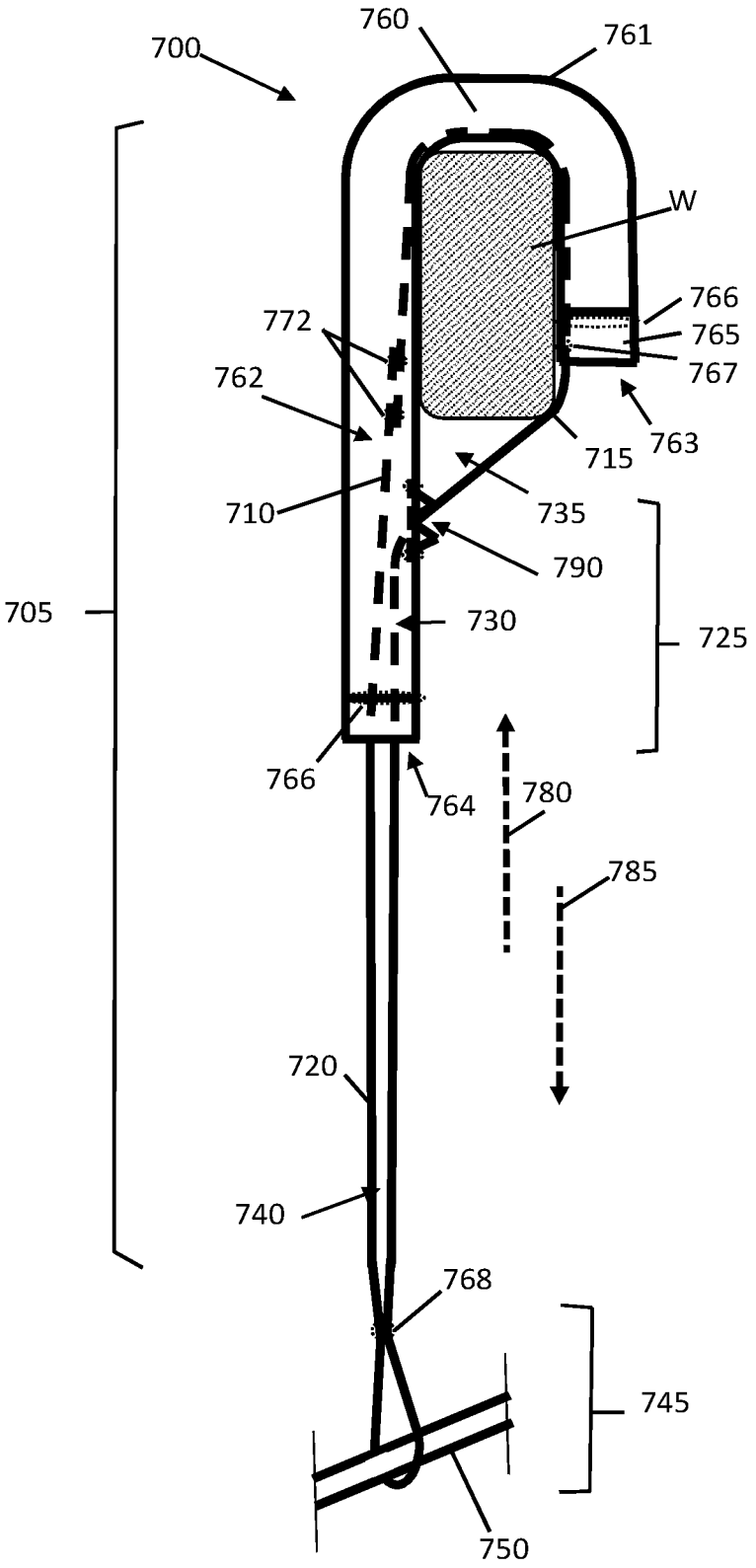
FIG. 16 is an alternative embodiment similar to FIG. 7, in this case having a strap that is a continuous loop formed by attaching the ends of the strap within the tube of flexible material.

Another embodiment is shown in FIG. 16, where strap 705 external to the tube 761 may be continuous because strap 705 is stitched into a single loop by threads 772 within tube 761. In this embodiment, third closed shape 745 is formed by a single loop of strap 705, for example by stitching with threads 768 or otherwise binding strap 705 to form closed shape 745 for attaching to a carabiner or a resistance band or anchor or other implement for using device 700 in exercising, as described above.

The embodiments of the invention described above provide an exercise device with a strap with an adjustable opening, into which a portion of the user's limb, e.g., the wrist, ankle, hand, foot, elbow, knee, etc., may be inserted. The strap also may be coupled, e.g., at a fixed opening, to a resistance mechanism, such as a resistance band or a weight bar. The strap may be configured to tighten the adjustable opening onto the user's limb when the user applies a force in opposition to the resistance mechanism. The adjustable opening's tightening in this manner provides for the user's limb to be held by the strap without the user's gripping either the strap or any other object including the resistance mechanism. The adjustable opening may tighten on the user's limb at the onset of exercise without the use of a separate tightening mechanism such as a buckle or Velcro. In this manner, the exercise device's coupling to the user's limb is self-adjusting, so the user does not have to adjust the fit or tightness around the limb. Use of this exercise device does not require use of the user's grip or any other effort to keep the tension of the device on the user's limb.

Specific details are given in the above description to provide a thorough understanding of the embodiments. However, it is understood that the embodiments may be practiced without these specific details. For example, structures may be shown in simplified diagrams in order not to obscure the embodiments in unnecessary detail. In other instances, well-known processes, structures, and techniques may be shown without unnecessary detail in order to avoid obscuring the embodiments.

While the principles of the disclosure have been described above in connection with specific apparatuses and methods, it is to be clearly understood that this description is made only by way of example and not as limitation on the scope of the disclosure.

What is claimed is:

1. An exercise device configured to couple a user's limb to a resistance mechanism and to tighten on the user's limb by a force applied in opposition to the resistance mechanism, the device comprising:

a strap including a first portion, a second portion, and a third portion, the strap defining a first closed loop shape providing an adjustable opening configured to receive the user's limb, a second closed loop shape coupled to the strap at a first location and wherein the second portion and the third portion of the strap are attached to a third closed loop shape configured for coupling to the resistance mechanism for application of force from the user's limb to the resistance mechanism;

a fixed opening provided by the second closed loop shape coupled to the strap, wherein the adjustable opening of the strap is formed by passing the second portion of the strap through the fixed opening, the second portion of the first strap being movable within the fixed opening, wherein the adjustable opening is configured to tighten on the user's limb by the force applied in opposition to the resistance mechanism, and wherein the first location where the second closed loop shape is coupled to the strap determines a minimum size of the adjustable opening, wherein the minimum size of the adjustable opening is sized to accommodate the user's limb; and a flexible material coupled to the strap, wherein the flexible material provides the second closed loop shape and the fixed opening, and wherein the flexible material defines a tube and the strap is at least partially disposed within the tube, and wherein the tube defines a first major opening and a second major opening and a channel therebetween, and the strap passes through the channel, and wherein the tube defines a slit opening to the channel, and wherein the adjustable opening is formed by the strap extending through the slit into the channel and out through the second major opening.

2. The device as recited in claim 1 wherein the fixed opening is defined by the tube between the slit and the second major opening.

3. The device as recited in claim 1 wherein the strap is fixed to the tube adjacent the first major opening.

4. The device as recited in claim 1 wherein the tube is formed using a rectangular piece of the flexible material, the rectangular piece defining a pair of long ends and a pair of short ends, further wherein the tube is formed by attaching together the long ends of the rectangular piece of the flexible material.

5. The device as recited in claim 4 wherein the long ends are stitched together inside the tube.

6. The device as recited in claim 1 and further comprising a shield coupled to the tube adjacent the slit.

7. The device as recited in claim 1 wherein the tube is formed of a foam material.

8. The device as recited in claim 7 wherein the tube is formed of neoprene.

9. The device as recited in claim 1 wherein the third closed loop shape is formed integrally by the second portion and the third portion of the strap and wherein the second portion and the third portion are attached to one another to complete the third closed loop shape.

10. The device as recited in claim 1 further comprising a carabiner attached at the third closed loop shape.

11. The device as recited in claim 1 further including a resistance band attached at the third closed loop shape.

12. The device as recited in claim 11 wherein the resistance band is stitched to the third closed loop shape.

13. An exercise device configured to couple a user's limb to a resistance mechanism and to tighten on the user's limb by a force applied in opposition to the resistance mechanism, the device comprising:

a strap including a first portion, a second portion, and a third portion, the strap defining an adjustable opening configured to receive the user's limb, and wherein the second portion and the third portion of the strap are attached to a closed loop shape configured for coupling to the resistance mechanism;

a flexible material coupled to the strap, wherein the flexible material is arranged in a tube defining a first major opening and a second major opening and a channel therebetween, and wherein the strap passes through the channel, the tube further including a slit and defining a fixed opening between the slit and the second major opening, wherein the adjustable opening of the strap is formed by passing the second portion of the strap through the fixed opening, wherein the adjustable opening is configured to tighten on the user's limb by the force applied in opposition to the resistance mechanism.

14. The device as recited in claim 13 wherein the tube is formed using a rectangular piece of the flexible material, the rectangular piece defining a pair of long ends and a pair of short ends, further wherein the tube is formed by attaching together the long ends of the rectangular piece of the flexible material.

15. The device as recited in claim 14 wherein the long ends are stitched together inside the tube.

16. The device as recited in claim 13 further comprising a shield coupled to the tube adjacent the slit.

17. An exercise device configured to couple a user's limb to a resistance mechanism and to tighten on the user's limb by a force applied in opposition to the resistance mechanism, the device comprising:

a strap including a first portion, a second portion, and a third portion, the strap defining an adjustable opening configured to receive the user's limb, and wherein the second portion and the third portion of the strap are attached to a closed loop shape configured for coupling to the resistance mechanism;

a flexible material coupled to the strap, wherein the flexible material is arranged in a tube defining a first major opening and a second major opening and a channel therebetween, and wherein the strap passes through the channel, the tube further including a slit and defining a fixed opening between the slit and the second major opening, wherein the adjustable opening of the strap is formed by passing the second portion of the strap through the fixed opening, wherein the adjustable opening is configured to tighten on the user's limb by the force applied in opposition to the resistance mechanism, and wherein the strap is coupled to the tube adjacent the first major opening.

18. The device as recited in claim 17 further comprising a carabiner attached at the closed loop shape.

19. The device as recited in claim 17 further including a resistance band attached at the closed loop shape.

20. The device as recited in claim 19 wherein the resistance band is stitched to the closed loop shape.

* * * * *